US006229980B1

(12) United States Patent
Ogawa et al.

(10) Patent No.: US 6,229,980 B1
(45) Date of Patent: May 8, 2001

(54) DEVELOPING APPARATUS FEATURING FIRST AND SECOND DEVELOPER CHAMBERS AND GUIDE MEMBER FOR DIRECTING STRIPPED-OFF DEVELOPER

(75) Inventors: Kenya Ogawa, Numazu; Yukihiro Ozeki, Yokohama; Katsuhiro Sakaizawa, Numazu; Takeshi Yamamoto, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/209,494

(22) Filed: Dec. 11, 1998

(30) Foreign Application Priority Data

Dec. 12, 1997 (JP) ..... 9-362589
Nov. 27, 1998 (JP) ..... 10-354004

(51) Int. Cl.[7] ..... G03G 15/08
(52) U.S. Cl. ..... 399/283; 399/284
(58) Field of Search ..... 399/283, 284, 399/285, 286, 279, 265, 252, 119, 120; 222/DIG. 1

(56) References Cited

U.S. PATENT DOCUMENTS 4,601,259 * 7/1986 Yamashita ..... 399/119
4,947,211 * 8/1990 Ono et al. ..... 399/283 X
5,337,124 * 8/1994 Schmidlin et al. ..... 399/282

FOREIGN PATENT DOCUMENTS 56-13945 2/1981 (JP) .
58-116559 7/1983 (JP) .
59-53856 3/1984 (JP) .
59-61842 4/1984 (JP) .
36-10231 7/1986 (JP) .

* cited by examiner

*Primary Examiner*—Arthur T. Grimley
*Assistant Examiner*—Hoan Tran
(74) *Attorney, Agent, or Firm*—Fitzpatrick, Cella, Harper & Scinto

(57) ABSTRACT

A developing apparatus has a developer carrying member for carrying a developer thereon and conveying it to a developing area opposed to an image bearing member, an agitating member for agitating the developer to be supplied to the developer carrying member and a stripping device for stripping off the developer having passed the developing area from the developer carrying member wherein the developer stripped off from the developer carrying member by the stripping device is guided to a position farther from the developer carrying member than a position at which the agitating member is disposed.

15 Claims, 12 Drawing Sheets

DEVELOPING APPARATUS FEATURING FIRST AND SECOND DEVELOPER CHAMBERS AND GUIDE MEMBER FOR DIRECTING STRIPPED-OFF DEVELOPER

BACKGROUND OF THE INVENTION

1. Field of the Invention

This invention relates to a developing apparatus for visualizing an electrostatic latent image formed on an image bearing member such as an electrophotographic photosensitive member or an electrostatic recording dielectric member.

2. Related Background Art

As the output means of an external apparatus such as a computer, or a copying apparatus, there is an image forming apparatus using the electrophotographic method as shown, for example, in FIG. 6 of the accompanying drawings.

The image forming apparatus has an electrophotographic photosensitive member usually in the form of a drum as an image bearing member, i.e., a photosensitive drum 100, and the surface of this photosensitive drum 100 is uniformly charged by a primary charger 117. Next, a light 123 is applied by an exposure device correspondingly to image information inputted from an external apparatus, and an electrostatic latent image is formed on the surface of the photosensitive drum 100. This latent image is reversely developed by a developing apparatus 140 by the use of a developer T having a frictional charging polarity of the same polarity as the applied voltage of the primary charger 117, and is visualized as a toner image.

This toner image is transferred onto a transfer material P supplied to the photosensitive drum 100 by a transfer charger 114. The transfer material P having the toner image transferred thereto is separated from the photosensitive drum 100, and then is conveyed to a fixating device 126, where the toner image is fixated as a permanent image on the transfer material P. On the other hand, the photosensitive drum 100 has any untransferred developer T remaining on its surface removed by a cleaning device 116 and is used for the next image forming process.

The developing apparatus 140 is a magnetic one-component developing apparatus and a typical example of the construction thereof is shown in FIG. 7 of the accompanying drawings. This developing apparatus 140 contains in a developing container 140A a negatively chargeable magnetic toner containing a magnetic material as the developer T.

The developing apparatus 140 has its inner lower portion compartmented into a first toner agitating chamber A and a second toner agitating chamber B by a partition plate 108, and first and second toner agitating members 109 and 106 are installed in the first and second agitating chambers A and B, respectively. A developing sleeve 102 rotatable in the direction of arrow in FIG. 7 is installed in an opening portion on the first agitating chamber A side of the developing apparatus 140 which faces the photosensitive drum 100 (FIG. 6), and a magnet roller 110 is disposed in this developing sleeve 102. An elastic blade (developing blade) 103 as a toner amount regulating member is fixed to that portion of the developing apparatus which is above the developing sleeve 102, and depends onto and elastically bears against the developing sleeve 102.

The magnetic toner T contained in the developing apparatus 140 is conveyed from the second agitating chamber B to the first agitating chamber A by the rotation of the second agitating member 106 in the direction of arrow in FIG. 7. The first agitating member 109 is rotated in the same direction to thereby rotate the conveyed toner T near the developing sleeve 102 and create the circulation of the toner so that a constant amount of toner may always be supplied to the developing sleeve 102.

The first and second agitating members 109 and 106 each are formed by one of various rotatable plate materials, screws, rollers or the like, and are rotated at an appropriate speed to efficiently convey the toner T. The partition plate 108 present between the first and second agitating members 109 and 106 has its height made proper to thereby make the amount of toner in the first agitating chamber A substantially constant thus contributing to creating the circulation of a constant amount of toner.

If the amount of toner in the first agitating chamber A is too small, the amount of toner circulated near the developing sleeve 102 will also become small and a sufficient amount of toner cannot be supplied to the developing sleeve 102. If the amount of toner in the first agitating chamber A is too great, the toner will excessively fill up and the irregular coat or streaks or the like of the toner will become liable to occur on the developing sleeve 102. Accordingly, the height of the partition plate 108 is made proper so as to provide a medium amount. A great amount of toner T is contained in the second agitating chamber B.

The developing sleeve 102 comprises a cylindrical member of a non-magnetic electrically conductive metal such as aluminum or stainless steel, and in the present example, it has a diameter of 16 mm.

The developing sleeve 102 is disposed with a predetermined gap kept between it and the photosensitive drum 100 by a gap regulating member, not shown.

The magnet roller 110 which is magnetic field producing means in the developing sleeve 102 is fixed to the side wall of the developing apparatus 140 and is disposed concentrically and nonrotatably in the developing sleeve 102. The developing sleeve 102 is rotated around the magnet roller 110.

The magnet roller 110, as shown, is provided with four magnetic poles S1, S2, N1 and N2, and the magnetic pole S1 is a developing pole, the magnetic pole N1 is a toner amount regulating pole, the magnetic pole S2 is a toner introducing and conveying pole, and the magnetic pole N2 is a toner blow-out preventing pole.

The magnetic toner T supplied by the first agitating member 109 is carried on the developing sleeve 102 by the magnetic force of the magnet roller 110, and is conveyed toward a developing area opposed to the photosensitive drum 100 with the rotation of the developing sleeve 102. In the course of the conveyance, the toner has its layer thickness regulated by the elastic blade 103 bearing against the developing sleeve 102, and is formed into a thin toner layer 107 prescribed to an amount of toner to be conveyed to the developing area.

The toner T conveyed to the developing area flies and adheres to the electrostatic latent image on the photosensitive drum 100 by a developing electric field by a developing bias applied to between the developing sleeve 102 and the photosensitive drum 100, and visualizes the latent image as a toner image.

Descretely from the magnetic one-component developing apparatus as described above, a non-magnetic one-component developing apparatus has recently been put into practical use as a simple color developing apparatus. This non-magnetic one-component developing apparatus, as shown, for example, in FIG. 8 of the accompanying drawings, can assume a construction resembling that of the magnetic one-component developing apparatus. This non-magnetic one-component developing apparatus 240 contains therein a non-magnetic toner T which is an insulative one-component developer, and in the present example, the non-magnetic toner T is negatively chargeable and contains any one of yellow, magenta, cyan and black pigments.

In a non-magnetic one-component developing method, the supply of the toner T to a developing sleeve 202 by a magnetic force is impossible and therefore, instead of a magnet roller being provided in the developing sleeve 202, a toner supply roller 205 made of urethane sponge which serves also to strip off the toner is installed so as to bear against the developing sleeve 202.

The supply roller 205 bears against the developing sleeve 202 and is rotated in the same direction as the latter to thereby supply the non-magnetic toner T onto the developing sleeve 202 and at the same time, strips off any toner remaining after the development in the developing area off the developing sleeve 202. The toner T supplied to the developing sleeve 202 adheres to and is carried on the developing sleeve 202 by a reflecting force or the like attributable to the frictional charging charges possessed by the toner.

Also, an elastic blade 203 of urethane rubber as a developing blade bears against the developing sleeve 202, and regulates the layer thickness of the toner T carried on the developing sleeve 202, whereby the toner is formed into a thin toner layer 207 of a predetermined amount. The amount of the toner of the thin toner layer 207 formed on the developing sleeve 202 is determined by the contact pressure, contact length, etc. of the elastic blade 203 bearing against the developing sleeve 202.

The elastic blade 203 is a chip blade adhesively secured or welded onto a metallic thin plate 204 of phosphor bronze or stainless steel having a thickness of several 100 $\mu$m, and uniformly bearing against the developing sleeve 202 by the elasticity of the metallic thin plate 204. The bearing condition of the developing blade 203 is determined by the material, thickness, angle of approach and set angle of this metallic thin plate 204, and the amount of toner on the developing sleeve 202 after being regulated is of the order of 0.3 to 1.0 mg/cm$^2$ per surface unit area.

The non-magnetic toner T conveyed to the developing area, as in the aforedescribed magnetic one-component developing method, flies to and develop the latent image on the photosensitive drum 100 under the application of a developing bias, and visualizes the latent image as a toner image.

The toner T will now be described. As methods of manufacturing a toner, there have heretofore been a so-called crushing method of uniformly dispersing a parting agent, a coloring agent, a charge controlling agent or the like comprising resin or a low softening point substance by the use of a pressing kneader, an extruder or a media dispersing machine, thereafter causing it to collide against a target mechanically or under a jet stream to thereby minutely crush it into a desired toner particle diameter, and thereafter sharpening the particle size distribution via the classifying step, and making a toner; a method of using a disc or a multifluid nozzle described in Japanese Patent Publication No. 56-13945, etc. to atomize a molten mixture in the air to thereby obtain a globular toner; a method using a suspension polymerizing method described in Japanese Patent Publication No. 36-10231, Japanese Patent Application Laid-Open Nos. 59-53856 and 59-61842 to directly produce a toner; a dispersion polymerizing method using a water organic solvent capable of dissolving monomers but incapable of dissolving polymers to directly produce a toner; and an emulsion polymerizing method typified by a soap free polymerizing method of directly polymerizing under the presence of a water-soluble polarity polymerization starting agent to thereby produce a toner; and any of these methods can be utilized for the manufacture of the toner.

A toner manufactured by the suspension polymerizing method under normal pressure or under pressure is preferable as the polymeric toner. According to the suspension polymerizing method, fine particle toner of which the particle size distribution is sharp and which has a particle diameter of 4 to 8 $\mu$m can be obtained relatively easily and the shape thereof is globular and the surface thereof is smooth.

A description will now be made of coefficients SF-1 and SF-2 showing the shape of the toner. The shape coefficients SF-1 and SF-2 were defined as values obtained from the following expressions by using FE-SEM (S-800) produced by Hitachi Works, Ltd. to sample 100 toner particle images at random, introducing the image information into an image analyzing apparatus (Luzex 3) produced by N1colet Japan Corporation through an interface, and effecting an analysis.

$$SF\text{-}1=\{(MXLNG)^2/AREA\}\times(\pi/4)\times 100$$

$$SF\text{-}2=\{(PERI)^2/AREA\}\times(\pi/4)\times 100,$$

where

AREA: toner projection surface,

MXLNG: absolute maximum length,

PERI: peripheral length.

This SF-1 shows the degree of globular shape, and if it is greater than 140, the toner gradually becomes an indefinite shape from the globular shape. SF-2 shows the degree of unevenness, and if it is greater than 120, the unevenness of the surface of the toner becomes remarkable. If SF-1 exceeds 140 or SF-2 exceeds 120, the fog of the toner may increase or the durability of the toner may be somewhat inferior.

The operational effect of the globular shape of the toner is that the fluidity of the toner is improved and the mechanical stress of the toner is decreased. Also, it becomes possible to obtain transfer efficiency up to nearly 100%. In a toner of an indefinite shape such as a crush toner, if the pressing force is high in the transfer by a transfer roller, the toner is mechanically pressed against the photosensitive drum and the unsatisfactory transfer of the so-called "blanks in characters" becomes liable to occur, but it hardly occurs in the globular toner.

According to the suspension polymerizing method, it is possible to make a toner containing a low softening point substance. Specifically, the polarity of a material in a water medium is set so as to be smaller in the low softening point substance than in a main monomer, and a small amount of resin or monomer which is great in polarity is further added, whereby there can be obtained a toner having the so-called core/shell structure in which the inside low softening point substance is covered with shell resin.

As regards the control of the particle diameter of the toner and the control of the particle size distribution of the toner, a predetermined toner can be obtained by a method of changing the kind and the amount of addition of soft water soluble inorganic salt or a dispersing agent acting as protective colloid, or by controlling mechanical apparatus conditions, e.g. the peripheral speed of a rotary, the frequency of pass, an agitating condition such as the shape of an agitating vane and the shape of a container, or the concentration of a solid component in a water solution.

In a polymeric toner having the core/shell structure, a low softening point substance is used as a core substance, whereby heat fixation by an amount of heat smaller than in the prior art becomes possible. Accordingly, a low softening point substance is preferable as the main component of the core portion, and compounds in which the maximum peak value of the main component measured in conformity to ASTM D3418-8 exhibits 40 to 90° C. are preferable. If the maximum peak value is less than 40° C., the self-cohesive power of the low softening point substance becomes weak and as the result, a high temperature offset property becomes weak, and this is not preferable. If the maximum peak exceeds 90° C., a fixation temperature becomes high, and this is not preferable. Further, when a toner is to be directly obtained by a polymerizing method, granulation and polymerization are effected by water and therefore, if the temperature of the maximum peak value is high, the low softening point substance is deposited chiefly during the granulation and hinders the suspension system, and this is not preferable.

For example, DSC-7 produced by Perkin-Elmer Inc. is used for the measurement of the temperature of the maximum peak value. The fusing points of indium and zinc are used for the temperature correction of an apparatus detecting portion, and the heat of fusion of indium is used for the correction of the quantity of heat. A pan made of aluminum was used as a sample, and for reference, an empty pan was set and measurement was effected at a temperature rise speed of 10° C./min.

Further, by using a substance of a high parting property as a core substance, it is also possible to prevent the fusion of the toner to a fixating roller. Thus, it becomes unnecessary to apply a molding lubricant such as silicone oil to the fixating device and therefore, the construction of the fixating device becomes simple and the fixating device can be made low in cost and maintenance-free.

As the low softening point substance providing the core substance, utilization can be made, specifically, of paraffin wax, polyolefin wax, fischer-tropsch wax, amide wax, high-class fatty acid, ester wax and graft/block compounds of these.

Also, it is preferable to add 2 to 30% by weight of low softening point substance to the toner. If the amount of addition is less than 2% by weight, a burden is required for the removal of the aforementioned remaining monomer, and if the amount of addition exceeds 30% by weight, the union of toner particles is liable to occur during granulation in the manufacture by the polymerizing method, and a toner in which the particle size distribution is wide is liable to be produced, and this is unsuitable.

There is a tendency toward the smaller size of the toner as a part of the recent higher quality of electrophotographic images, but the energy required to crush particles is proportional to the minus square of the diameter of the particles and therefore, it is difficult to make the particle diameter of the toner smaller by the crushing method. In contrast, the polymerizing method produces toner particles by the use of chemical reaction and therefore, according to this method, it is easy to make the particle diameter of the toner smaller and it is also easy to obtain a sharp particle size distribution and thus, the polymerizing method is a toner manufacturing method suitable for the image formation of high quality.

As previously described, according to the one-component developing apparatus, it becomes possible to form a thin toner layer suitable for development on the developing sleeve by a simple construction and therefore, the downsizing and simpler maintenance of the electrophotographic apparatus become possible.

In the above-described one-component developing apparatus, however, image outputting repeated for a long period has led to the problem that image density is reduced or the dot reproducibility of halftone image portions is reduced.

Specifically, in the one-component developing apparatus, in order to form a thin toner layer on the developing sleeve, it is required to let the toner pass the developing blade brought close to or urged against the developing sleeve, but the toner has been changed in its physical property values including chargeability by stress and frictional heat received from the developing blade, and the developing characteristic thereof has been aggravated.

When the developing blade is brought into contact with the developing sleeve, for example, when an elastic blade bears against a rigid sleeve made of a metal or a metallic blade bears against an elastic sleeve, good toner friction chargeability and a uniform thin toner layer are obtained and therefore, an image output of high quality is obtained by a simple construction, but when compared with the toner regulation by a magnetic blade or the like which is not in contact with the developing sleeve, the toner is particularly liable to be deteriorated by the creation of the stress and a great deal of frictional heat when the toner passes the developing blade as described above, and accordingly the compatibility of the higher quality of image and longer life of the developing apparatus is hindered.

The temperature rise by the frictional heat of the toner when it passes the developing blade is said to reach several 10° C. in a microscopic area, i.e., the surface of the toner, and when the toner continuously passes the developing blade while adhering to the developing sleeve, the rise of the surface temperature of the toner becomes still higher and at last, locally melts the surface of the toner and an extraneous additive present on the surface of the toner is embedded into a toner binder to thereby deteriorate the chargeability of the toner or make the cohesive power between toner particles rise. That is, by the toner continuously passing the developing blade, the surface temperature of the toner rises to deteriorate the toner, and a reduction in the density of image and the irregularity of the density of halftone portions are caused.

In the magnetic one-component developing apparatus shown in FIG. 7, the toner on the developing sleeve 102 is present on the developing sleeve 102 unless it is used for the development of the latent image on the photosensitive drum 100 and therefore, it continuously passes the developing blade 103 and thus, the toner is deteriorated. Most ordinary text images are 10% or less in printing rate and in this case, about 90% of the toner on the developing sleeve is exposed to deterioration without being used for development.

Reducing the regulated pressure of the developing blade reduces the quantity of heat produced per passage of the toner and is therefore effective for the prevention of the deterioration of the toner, but reduces also the frictional charge imparting property to the toner and thus, particularly under a high humidity environment, the toner cannot have a sufficient amount of frictional charging charges, and a reduction in the density of image and the scattering of the toner around character images are caused and thus, the compatibility of a higher quality of image and a longer life is difficult.

In the non-magnetic one-component developing apparatus shown in FIG. 8, the charging up of the toner by the toner continuously passing the developing blade 203 is prevented by the supply roller 205 stripping off the toner on the developing sleeve 202. However, the toner thus stripped off is present in the first agitating chamber A and is circulated near the developing sleeve 202 and therefore, as the result, the temperature of the toner has risen to cause the deterioration of the toner.

The use of a globular toner in a one-component developing apparatus leads to the advantages that (1) the fluidity of the toner is improved and (2) the transfer efficiency is improved, and further the use of a globular polymeric toner leads to the additional advantages that (3) it is easy to make the particle diameter of the toner smaller and (4) the particle size distribution of the toner becomes sharp (and accordingly, the distribution of the amount of frictional charging charges of the toner becomes sharp).

Also, if the polymeric toner is given core/shell structure by the suspension polymerizing method, there are added the advantages that (5) the fixativeness and the anti-blocking property of the toner are compatible and (6) by a molding lubricant being used in the core portion of the toner, a member for applying a molding lubricant oil to the fixating roller can be simplified.

However, the globular toner, as compared with a crushed toner which is of an indefinite shape and is very uneven on the surface thereof, is small in friction and liable to slip because it is globular. Therefore, when it is used in the aforedescribed non-magnetic one-component developing apparatus, the globular toner slides away along the surface of the portion of contact between the developing sleeve 202 and the supply roller 205, and continuously passes the developing blade 203 and is deteriorated by the aforedescribed reason.

Also, by increasing the quantity of the low softening point substance in the toner, the quantity of heat necessary in the fixating device can be reduced and the lower power consumption of the electrophotographic apparatus can be achieved, but the threshold value of the temperature at which the surface of the toner is melted and deteriorated also lowers and therefore, the service life of the developing apparatus become shorter.

Also, as shown in Japanese Patent Application Laid-Open No. 58-116559, there is a non-magnetic one-component developing method using not a magnetic toner but a non-magnetic one-component toner. This developing method can provide color images corresponding to the recent demand for color images and further, can use a low-cost and compact developing apparatus and has been widely put into practical use.

FIG. 17 of the accompanying drawings shows an example of a developing apparatus using the non-magnetic one-component developing method.

In this example, the developing apparatus has a developing container 401 containing therein a developer, i.e., a non-magnetic one-component toner, and a developing roller 402 as a developer carrying member rotatably carried on the developing container 401 and rotatively driven in the direction of arrow. A toner supplying and collecting roller 415 as a developer supplying and collecting member and a blade 414 as a developer layer thickness regulating member bear against the developing roller 402. The blade 414 has an elastic member 414*b* of urethane rubber or the like adhesively secured to that surface of a support member 414*a* formed of phosphor bronze or the like which is opposed to the developing roller, whereby it has the action of forming a thin layer of toner on the surface of the developing roller 402 and imparting charges to the toner. The toner supplying and collecting roller 415 comprises a mandrel 415*a* of SUS or the like having its outer peripheral surface covered with an elastic member 415*b* of urethane foam or the like, whereby it has the action of supplying the toner contained in the developing container 401 to the surface of the developing roller 402 and also, scraping off the toner returned without contributing to the developing step from the surface of the developing roller 402.

By this construction, a thin layer of the non-magnetic one-component toner can be simply and easily on the developing roller 402, and it has become possible to develop a latent image on a latent image bearing member.

However, in the developing apparatus using the above-described non-magnetic one-component developing method, the toner supplying and collecting roller 415 is brought into contact with and rotated and frictionally slides relative to the developing roller 402 to thereby effect the supply and collection of the toner. Also, the imparting of charges to the toner is effected chiefly by the frictional contact when the toner passes the blade 414.

That is, in such a developing apparatus, during the time until the toner in the developing container 401 is used for the action of developing the electrostatic latent image in the developing portion, the mechanical load applied to the toner is very great and the damage thereby is very great as compared with the other developing methods.

Further, depending on the disposed position or the direction of rotation of the toner supplying and collecting roller 415, the toner which has not contributed to development cannot sometimes be collected completely, and in some cases, the toner has remained on the toner supplying and collecting roller 415. The toner remaining on the toner supplying and collecting roller 415 again passes the blade 414 portion and is conveyed to the developing portion, but when such a process is continuously repeated, an extraneous additive or the like controlling the amount of charge and fluidity of the toner is embedded into the interior of the toner by mechanical friction received each time or the accumulation of heat, and this often leads to a deteriorated toner of which the desired charging characteristic and fluidity cannot be obtained.

Such deteriorated toner causes many problems in the image forming process, and for example, when the deteriorated toner contributes to development, bad development by a proper developing characteristic being not obtained occurs or in some cases, bad transfer such as blank areas is caused. Further, the supply of fresh toner onto the developing roller 402 is alienated and a reduction in the amount of applied toner may occur to thereby cause bad density or the like.

Also, if such deteriorated toner fuses to the nip portion of the blade 414 and the surface of the developing roller 402, a bad coat such as streaks will be caused and will hinder the imparting of charges to the toner newly supplied onto the developing roller 402. Thus, an uncharged toner is conveyed to the developing area and bad image formation such as fog or irregularity may occur.

Also, according to the above-described developing apparatus, not only a load applied to. the toner is great, but also a load applied to the developing apparatus itself is great.

Further, when the sponge roller as described above is used as the toner supplying and collecting roller 415, if the frictional contact thereof with the developing roller 402 continues for a long time, the abrasion or damage of the toner supplying and collecting roller 415 itself and the clogging or the like by the toner may occur and thus, the function as the toner supplying and collecting roller 415 may become insufficient and good toner supply may become impossible.

As described above, the contact one-component developing apparatus using the non-magnetic one-component toner can form good toner images by a simple construction, while on the other hand the load applied to the toner and the developing apparatus is great, and as compared with the conventional magnetic one-component developing apparatus and two-component developing apparatus, such contact one-component developing apparatus is remarkably deficient in long-term durability and stability.

Accordingly, the contact one-component developing apparatus is utilized chiefly as a developing apparatus of the cartridge type in which the developing apparatus is bodily interchanged during toner replenishment, and is not so adopted in a developing apparatus of a type which is supplied with a developer as in a copying apparatus.

Also, in recent years, the development of a toner capable of being fixated at a lower temperature has been desired due to a reduction in consumed electric power, and a developing process of low stress corresponding to the toner for low temperature fixation is expected.

SUMMARY OF THE INVENTION

It is an object of the present invention to provide a developing apparatus for maintaining a high quality of image.

It is also an object of the present invention to provide a developing apparatus which can prevent the deterioration of a developer.

The developing device of the present invention has:

(a) a developer carrying member for carrying a developer thereon and conveying it to a developing area opposed to an image bearing member;

(b) an agitating member from agitating the developer supplied to the developer carrying member; and (c) stripping means for stripping off the developer having passed the developing area from the developer carrying member;

wherein the developer stripped from the developer carrying member by the stripping means is guided to a position farther from the developer carrying member than a position at which the agitating member is disposed.

The other objects and features of the present invention will become apparent from the following detailed description when read with reference to the accompanying drawings.

DETAILED DESCRIPTION OF THE PREFERRED EMBODIMENTS

Some embodiments of the present invention will hereinafter be described in detail with reference to the drawings.

Embodiment 1

Figure 1:
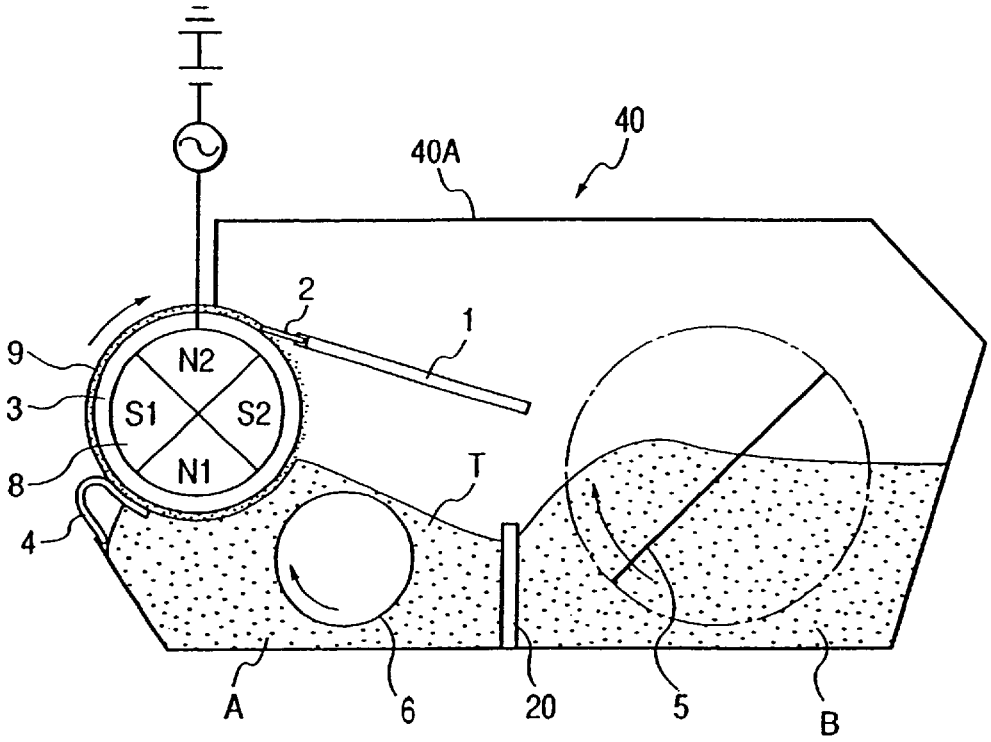
FIG. 1 is a cross-sectional view showing an embodiment of the developing apparatus of the present invention.

FIG. 1 is a cross-sectional view showing an embodiment of the developing apparatus of the present invention. The developing apparatus 40 of the present embodiment is a magnetic one-component developing apparatus and contains in a developing container 40A a magnetic toner T of negative chargeability containing a magnetic material.

The developing apparatus 40 has its inside compartmented into a first toner agitating chamber A for circulating an amount of toner necessary for development and a second toner agitating chamber B containing a great deal of toner therein by a partition plate 20, and first and second toner agitating members 6 and 5 are installed in the first and second agitating chambers A and B, respectively. A developing sleeve 3 rotatable in the direction of arrow in FIG. 1 is installed in an opening portion on the first agitating chamber A side of the developing apparatus 40 which faces a photosensitive drum, not shown, and a magnet roller 8 is disposed in the developing sleeve 3.

Also, an elastic blade (developing blade) 4 as a toner amount regulating member is fixed to that portion of the developing apparatus which is below the developing sleeve 3, and elastically bears against the developing sleeve 3. Above the first agitating member 6 in the first agitating chamber A, there is installed an inclined toner conveying plate 1 lowering toward the second agitating chamber B and having its one end facing the latter, and a scraper 2 as a toner stripping member is provided on the upper end which is the other end of the conveying plate 1 and the scraper 2 bears against the developing sleeve 3.

The magnetic toner T contained in the developing apparatus 40 is conveyed from the second agitating chamber B to the first agitating chamber A by the second agitating member 5 being rotated at a relatively low speed in the direction of the arrow. The first agitating member 6 is rotated at a relatively high speed in the same direction to thereby rotate the conveyed toner T near the developing sleeve 3 and create the circulation of the toner so that a sufficient quantity of toner may be supplied to the developing sleeve 3 at a high speed.

The developing sleeve 3 comprises an electrically conductive cylindrical member of aluminum having a diameter of 16 mm, and this developing sleeve 3 is disposed with a predetermined gap kept between it and a photosensitive drum 100 by a gap regulating member, not shown, and is rotated at a peripheral speed of 20 mm/sec.

The magnet roller 8 which is magnetic field producing means in the developing sleeve 3 is fixed to a side wall of the developing apparatus 40 and is disposed concentrically and nonrotatably in the developing sleeve 3. The developing sleeve 3 is rotated around the magnet roller 8.

The magnet roller 8, as shown, is provided with four magnetic poles S1, S2, N1 and N2, and the magnetic pole S1 is a developing pole, the magnetic pole N1 is a toner amount regulating pole, the magnetic pole S2 is a toner introducing and conveying pole, and the magnetic pole N2 is a toner blow-out preventing pole.

The magnetic toner T supplied by the first agitating member 6 is carried on the developing sleeve 3 by the magnetic force of the magnet roller 8, and is conveyed toward a developing area opposed to the photosensitive drum, not shown, with the rotation of he developing sleeve 3. In the course of the conveyance, the magnetic toner has its layer thickness regulated by the developing blade 4 bearing against the developing sleeve 3, and is formed into a thin toner layer 9 prescribed to an amount of toner conveyed to the developing area.

The developing blade 4 is an elastic blade formed of silicone resin, bears against the developing sleeve 3 in a counter direction relative to the direction of rotation of the latter with line pressure of 30 g/cm, regulates the toner on the developing sleeve 3 to thereby form the thin toner layer 9, and prescribes the amount of toner conveyed to the developing area and at the same time, imparts appropriate frictional charging charges of the order of −10 $\mu$C/g to the toner.

The toner T conveyed to the developing area flies and adheres to an electrostatic latent image on the photosensitive drum by a developing electric field by a developing bias applied to between the developing sleeve 3 and the photosensitive drum, and visualizes the latent image as a toner image. Any toner left in the development in the developing area is stripped off from the developing sleeve 3 by the scraper 2, passes the toner conveying plate 1 from gravity and is guided to the second agitating chamber B, and falls into the second agitating chamber B.

The roles of the scraper 2 and the toner conveying plate 1 provided in the present embodiment ill be further described below.

Figure 7:
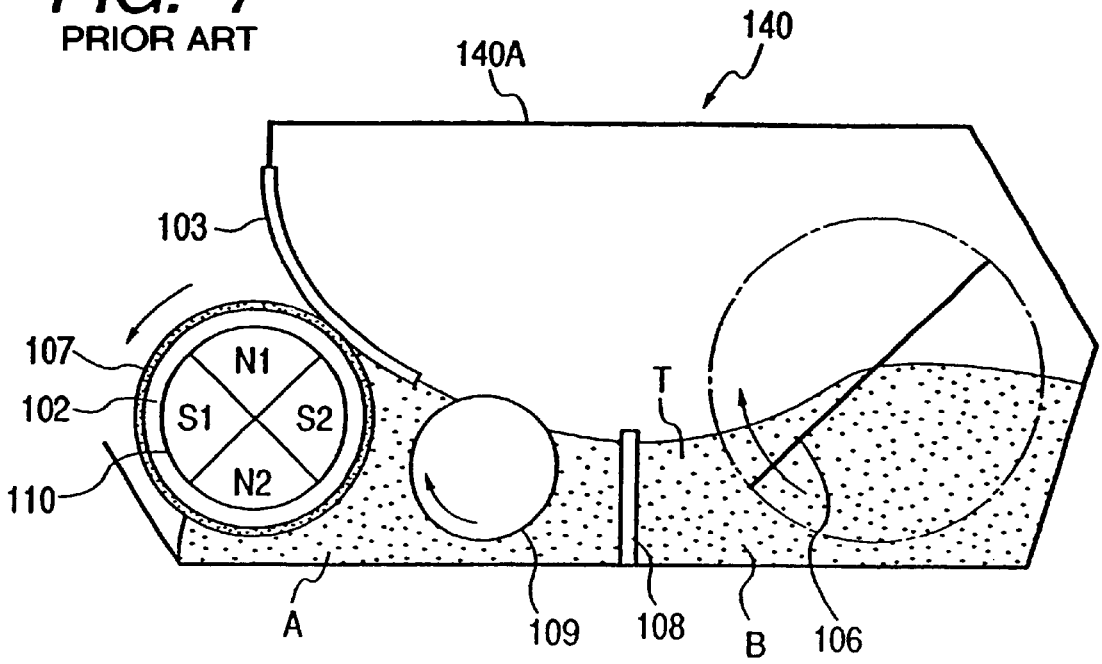
FIG. 7 PRIOR ART
FIG. 7 is a cross-sectional view showing a developing apparatus.
Figure 8:
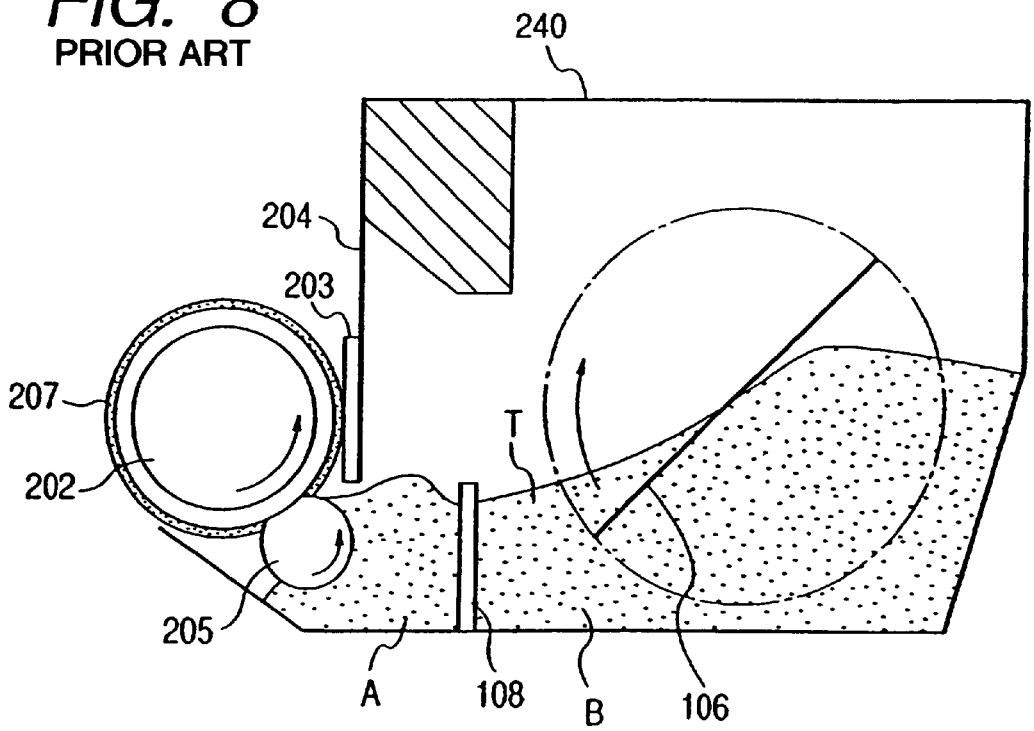
FIG. 8 PRIOR ART
FIG. 8 is a cross-sectional view showing another example of the developing apparatus.

First, in the magnetic one-component developing apparatus 140 shown in FIG. 7 wherein the scraper 2 and the toner conveying plate 1 are not provided, the magnetic toner T supplied to the developing sleeve 102 continuously passes the developing blade 103 many times until it is used for development and therefore, continues temperature rise by frictional heat generated, and at least the surface of the toner comes to be melted and the deterioration of the toner occurs.

Figure 2:
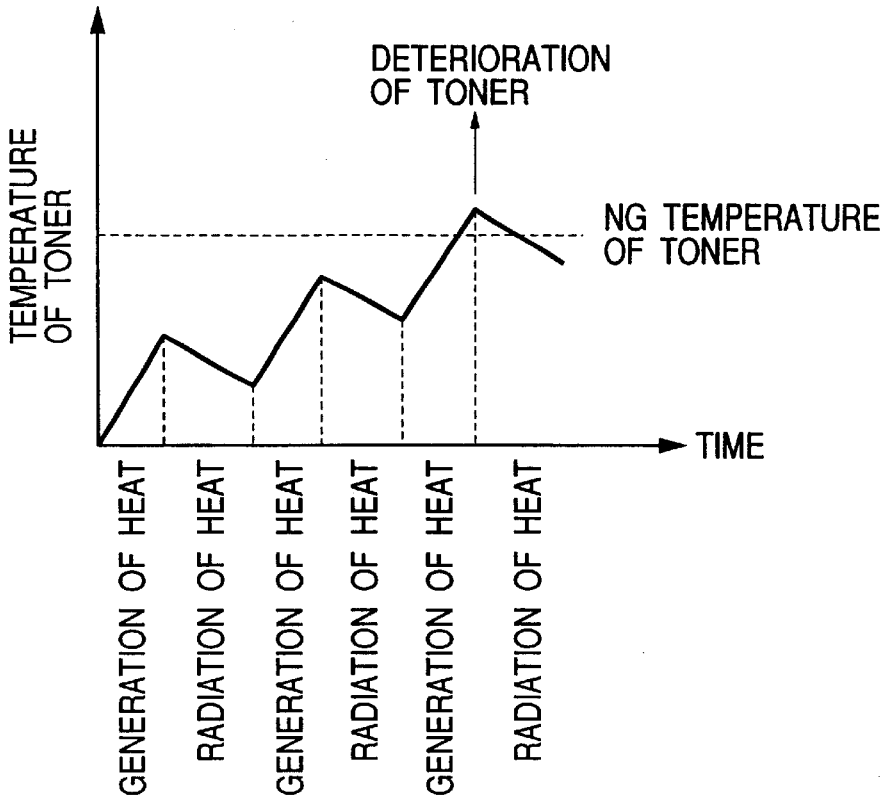
FIG. 2 is an illustration showing temperature changes in a toner in a one-component developing apparatus.

Actually, as shown in FIG. 2, the toner on the developing sleeve 102 generates heat by the friction thereof with the developing blade 103, whereafter the heat radiates in the other areas of the developing sleeve 102 than the portion thereof contacted by the developing blade 103, and to effect this radiation of heat efficiently, a sufficient heat medium and radiation time are necessary, and in a developing apparatus free of them, the toner again passes the developing blade 103 before the temperature of the surface of the toner drops sufficiently, thus causing a temperature rise.

In contrast, in the developing apparatus of the present embodiment, the toner on the developing sleeve 3 is stripped off by nearly 100% by the scraper 2 and therefore, it never happens that the toner continuously passes the developing blade 4 many times while adhering to the developing sleeve 3. Also, the toner stripped off is conveyed to the second agitating chamber B remote from the developing sleeve 3 and therefore, it never happens that the toner is supplied to the developing sleeve 3 immediately after being stripped off. Further, the toner conveyed to the second agitating chamber B effectively radiates heat since a great deal of toner present around it works as a heat medium.

Figure 3:
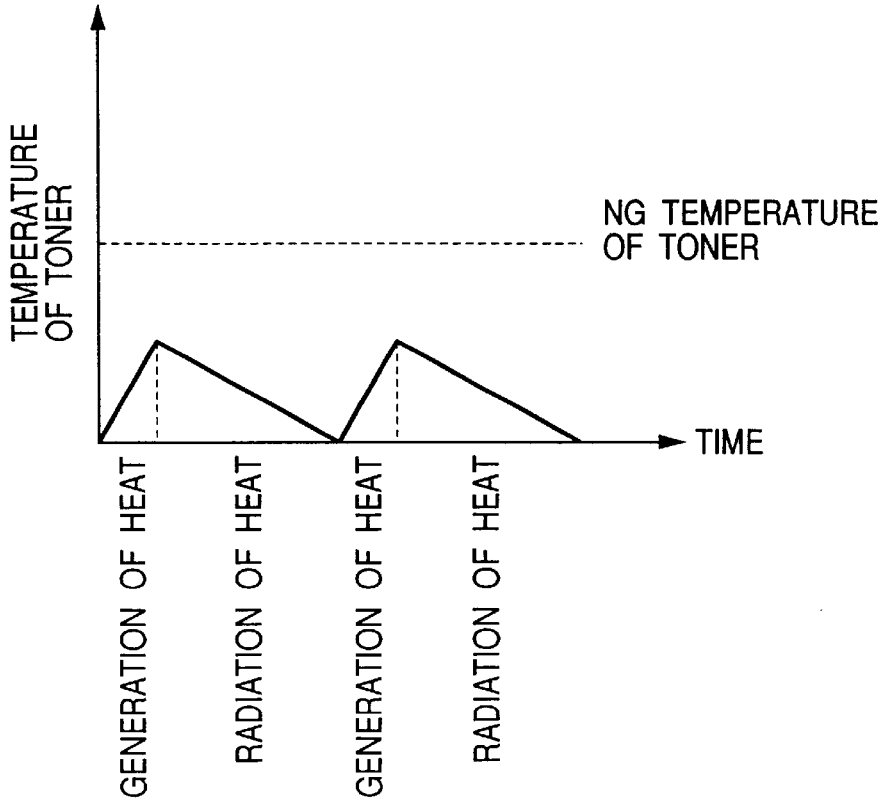
FIG. 3 is an illustration showing temperature changes in a toner in the developing apparatus of FIG. 1.

Therefore, as shown in FIG. 3, the toner on the developing sleeve 3 sometimes passes the developing blade 4 and rises in temperature, but that toner is removed from the developing sleeve 3 and sufficiently radiates heat, Thereafter it is again supplied to the developing sleeve 3 and thus, the temperature rise of the toner can be suppressed and the deterioration of the toner can be prevented.

As described above, according to the present embodiment, the toner on the developing sleeve 3 is stripped off and therefore, not only the occurrence of development ghost by the development history in the past can be prevented, but also the temperature rise by the toner on the developing sleeve continuously passing the developing blade can be prevented, and further the toner stripped off is returned into the second agitating chamber B and is made to radiate heat and therefore, the effective radiation by a great deal of toner and the extension of the radiation time of the toner can be realized, whereby it becomes possible to prevent the deterioration of the toner by heat.

Embodiment 2

Figure 4:
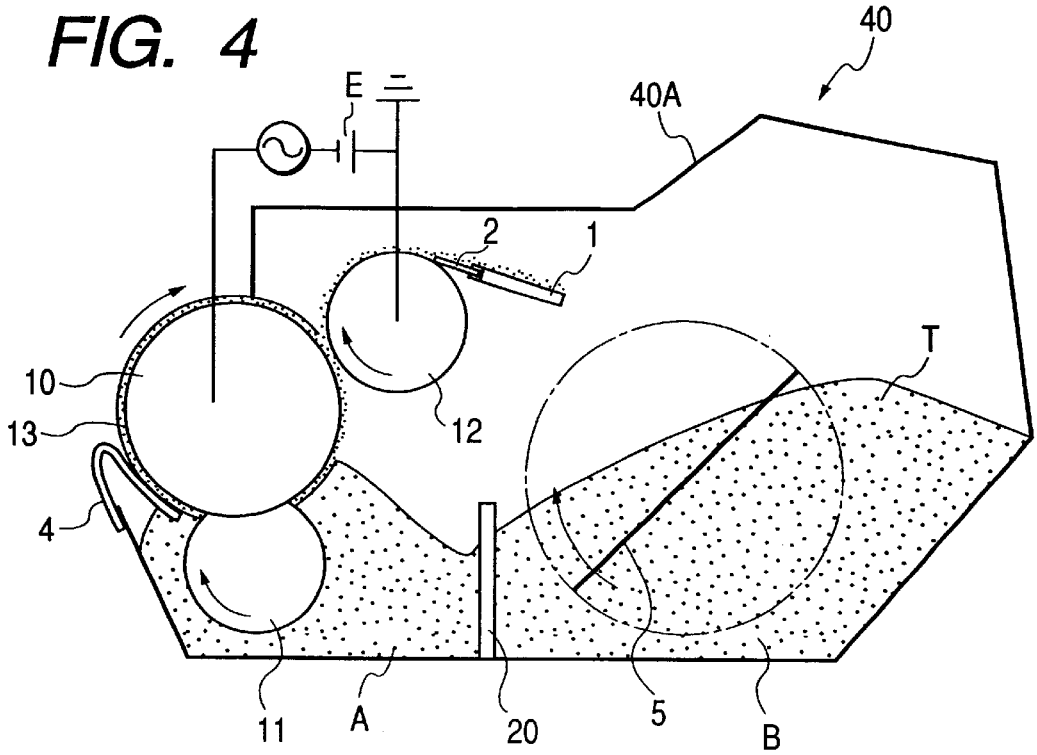
FIG. 4 is a cross-sectional view showing another embodiment of the developing apparatus of the present invention.

FIG. 4 schematically shows the construction of another embodiment of the developing apparatus of the present invention. This embodiment shows a case where the present invention is applied to a non-magnetic one-component developing apparatus.

In the present embodiment, use is made of a non-magnetic toner T which is a non-magnetic one-component developer and specifically, the toner T is a non-magnetic toner manufactured by the polymerizing method. A developing roller 10 having no magnet therein is installed as the developer carrying member of the developing apparatus 40, and a supply roller 11 bearing against the developing roller 10 and rotated is installed in the first agitating chamber A so as to supply the non-magnetic toner T to the developing roller 10. A stripping roller 12 having an electric field applied thereto is used as a member for stripping off the toner from the developing roller 10, and the scraper 2 provided on the toner conveying plate 1 bears against this stripping roller 12.

In the other points, the construction of this developing apparatus is basically the same as that of the developing apparatus of Embodiment 1 shown in FIG. 1, and in FIG. 4, the same members as the members in FIG. 1 are given the same reference characters and need not be described.

In the present embodiment, the developing roller 10 comprises a cylindrical member of aluminum having an outer diameter of 16 mm, and is disposed with a gap of 300

μm kept between it and a photosensitive drum, not shown. As the developing roller 10, use can also be made of a cylindrical member formed of an elastic material such as silicone rubber or urethane rubber, besides the metallic cylindrical member.

The non-magnetic toner T applied as a thin layer 13 onto the developing roller 10 by the developing blade 4 is conveyed to the developing area with the rotation of the developing roller 10, and develops and visualizes an electrostatic latent image on the photosensitive drum under the application of a developing bias (a DC voltage of −500 V+peak-to-peak voltage of 2 kV and an AC voltage of a frequency of 2 kHz).

The supply roller 11 circulates the toner in the first agitating chamber A and conveys it to near the developing roller 10 and also frictionally contacts with the developing roller 10 to thereby frictionally charge the toner to the negative polarity, and makes the toner adhere to the developing roller 10 by a reflecting force, whereby the toner is applied to the developing roller 10.

In the present embodiment, a roller of urethane sponge having an outer diameter of 14 mm is used as the supply roller 11, and it is made into a low-hardness article of Asker C hardness 20°, whereby it is made to elastically bear against the developing roller 10 to thereby enlarge the contact nip and improve the frictional charging property for the toner.

The developing blade 4 comprises an elastic member of urethane rubber, and the toner applied onto the developing roller 10 is regulated by the developing blade 4 and is formed into a thin toner layer 13 having a toner charge amount of −20 μC/g and a toner coat amount of 0.5 mg/cm$^2$.

The stripping roller 12 comprises an aluminum roller having an outer diameter of 14 mm, and is disposed with a gap of 300 μm kept between it and the developing roller 10. The toner carried on the developing roller 10 passes through a developing area opposed to the photosensitive drum, not shown, and is used for the development of an electrostatic latent image on the photosensitive drum, and any toner left after the development comes to the stripping roller 12. An electric field is formed between the developing roller 10 and the stripping roller 12 by the application of a bias from a bias voltage source E, and the toner left after the development on the developing roller 10 is stripped off from the developing roller 10 by this electric field, and flies and adheres to the stripping roller 12.

The toner adhering to the stripping roller 12 is stripped off by the scraper 2 bearing against the stripping roller 12. In the present embodiment, a polymeric toner which is globular and readily slides and can easily go through the portion of contact with the scraper 2 is used as the toner T and therefore, the scraper 2 is made to edge-bear against the stripping roller 12 with high contact pressure of 95 g/cm.

In the present embodiment, as described above, the stripping roller 12 for applying an electric field between it and the developing roller 10 is used and therefore, it becomes possible to strip off the toner on the developing roller 10 without directly frictionally contacting with the developing roller 10 and therefore, the injury and abrasion of the surface of the developing roller 10 can be prevented, and the toner coat on the developing roller 10 can be stabilized for a long period and at the same time, the globular toner like the polymeric toner can be well removed from the developing roller 10.

Since the developing roller 10 is not frictionally contacted, the developing roller 10 can be not only a metallic roller, but also a roller having a resin layer formed on the surface thereof or a roller generally formed of one of various soft rubber materials.

The toner stripped off by the scraper 2 is conveyed along the toner conveying plate 1 with the aid of gravity and falls into the second agitating chamber B. The toner which has fallen into the second agitating chamber B contacts with a great deal of toner around it for a sufficient time and a sufficient number of times and radiation takes place effectively, and sufficient heat is radiated, whereafter the aforementioned toner is conveyed to the first agitating chamber A with the other toner by the second agitating member 5 and is again supplied to the developing roller 10.

As described above, according to the present embodiment, the toner on the developing roller is stripped off and therefore, not only the occurrence of development ghost and irregular halftone by the development history in the past can be prevented, but also the effective radiation by the great deal of toner and the extension of the radiation time of the toner can be realized because the stripped-off toner is returned to the second agitating chamber B and the heat thereof is radiated, and it has become possible to prevent the deterioration of the toner by heat.

Further, by using the stripping roller 12, the toner can be stripped off without the developing roller 10 being worn out, and by the use of the polymeric toner of which the sharp charging charge distribution can be easily obtained, it has become possible to put out an image output of high quality for a long period.

In the foregoing, the stripping roller 12 is not in contact with the developing roller 10, but it is possible to use it in contact with the latter. Also, in the present embodiment, as the non-magnetic toner, use is made of the polymeric toner, but of course, it is also possible to use a crushed toner.

Also, while the present embodiment has been described with respect to a developing apparatus for the non-magnetic one-component toner, there is no problem in carrying out the developing process by using a magnetic toner in the present developing apparatus. In this case, the magnetic toner is used but no magnetic force is used, and the magnetic toner exhibits behavior similar to that of the non-magnetic toner. Further, the developing roller 10 may be made to contain a magnet therein. In this case a magnetic force is added to the conveyance of the toner on the developing roller 10. Accordingly, the present embodiment effectively acts on the magnetic toner. That is, it is also possible to use the magnetic toner, and the present embodiment has an effect similar to that of Embodiment 1.

Embodiment 3

Figure 5:
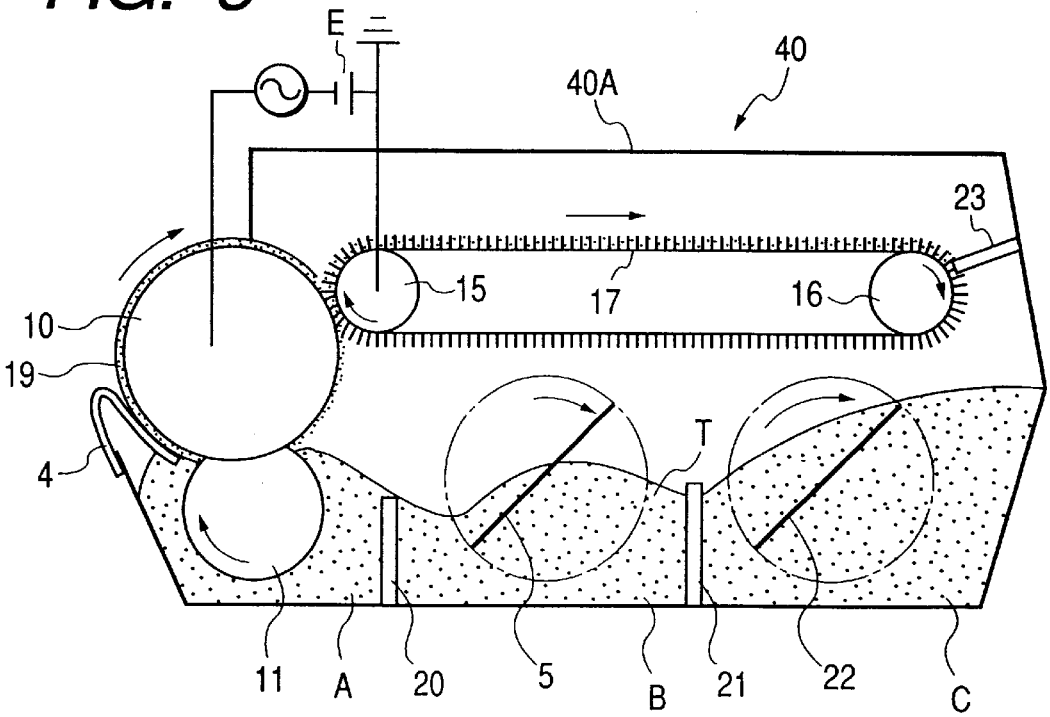
FIG. 5 is a cross-sectional view showing still another embodiment of the developing apparatus of the present invention.
Figure 6:
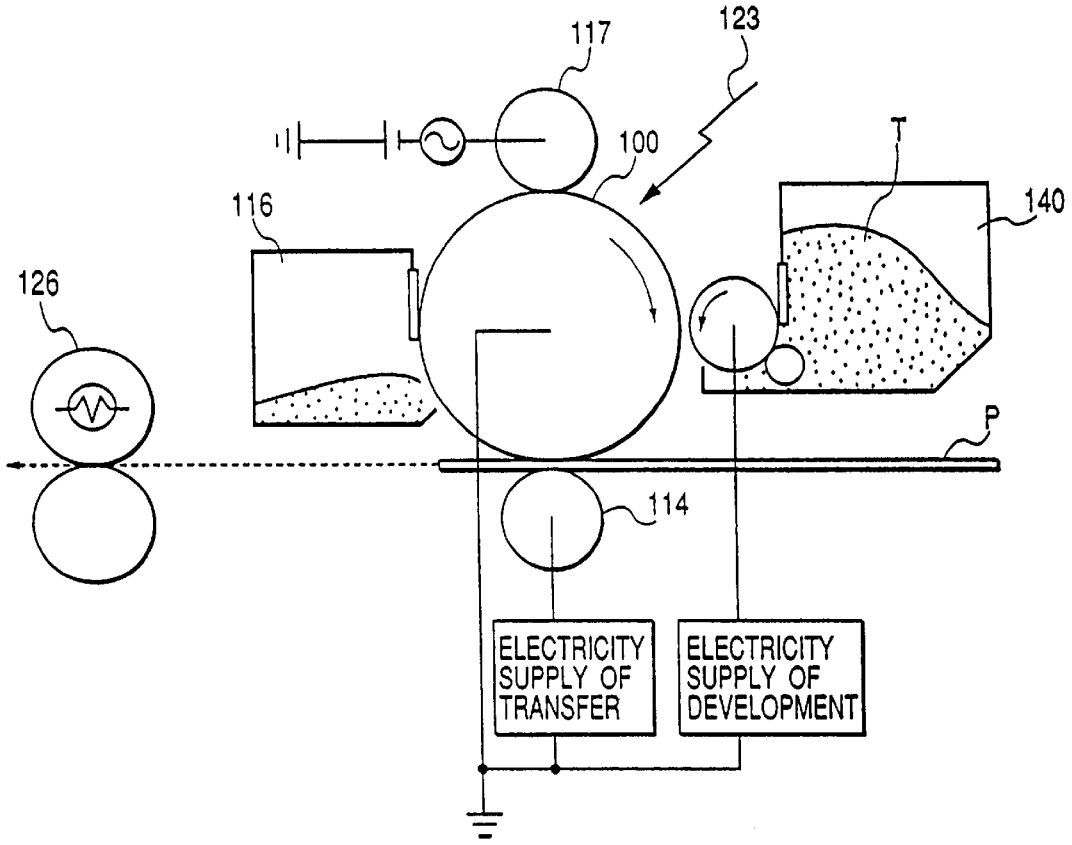
FIG. 6 PRIOR ART
FIG. 6 schematically shows the construction of an electrophotographic apparatus provided with a developing apparatus.

FIG. 5 schematically shows the construction of still another embodiment of the developing apparatus of the present invention.

This embodiment is such that in the non-magnetic one-component developing apparatus 40 shown in FIG. 4, instead of the stripping roller 12, there is installed a horizontal stripping belt 17 passed over a drive roller 15 and a driven roller 16. Also, a third toner agitating chamber C is extended adjacent to the second toner agitating chamber B and a toner agitating member 22 is installed therein. The leading end of the stripping belt 17 with respect to the direction of conveyance thereof bears against the developing roller 10, and the trailing end thereof comes to the third agitating chamber C. A flicker bar 23 is installed so as to bear the trailing end of the stripping belt 17.

In the other points, the construction of the present embodiment is basically the same as that of the developing apparatus of Embodiment 2 shown in FIG. 4, and in FIG. 5, the same members as the members in FIG. 4 are given the same reference characters and need not be described.

The agitating member 22 in the third agitating chamber C is rotated in the direction of the arrow to thereby convey the non-magnetic toner T in the third agitating chamber C to the second agitating chamber B, and the agitating member 5 in the second agitating chamber B is rotated in the direction of the arrow to thereby convey the non-magnetic toner T in the second agitating chamber B to the first agitating chamber A.

The supply roller 11 comprises a roller of urethane sponge having an outer diameter of 14 mm, and circulates the toner in the first agitating chamber A and also makes the toner frictionally contact with the developing roller 10, and makes the toner adhere and be applied to the developing roller 10 by the reflecting force.

The developing blade 4 formed of urethane rubber bears against the developing roller 10 to thereby regulate the toner on the developing roller 10 and form it into a thin toner layer 19 of which the toner charging amount is −20 $\mu$C/g and the toner coat amount is 0.5 mg/cm$^2$.

A latent image on the photosensitive drum, not shown (disposed with a gap of 300 $\mu$m kept between it and the developing roller 10) is developed under the application of a developing bias (a DC voltage of −500 V+peak-to-peak voltage of 2 kV and an AC voltage of a frequency 2 kHz), and any toner left in the development comes to the stripping belt 17. The stripping belt 17 is rotated by the rotative driving by the drive roller 15 while frictionally contacting with the developing roller 10 in a counter direction.

The surface of the stripping belt 17 is a brush layer of nylon fiber having a thickness of 6 deniers and a length of 2 mm. The reasons why the brush layer is provided are that (1) as compared with a smooth belt, the conveyance of a great deal of toner becomes possible and therefore, even if the moving speed of the stripping belt 17 is made lower than that of the developing roller 10, the toner stripped off from the developing roller 10 can be stably conveyed without the leakage of the toner being caused, and (2) the brush end of the brush layer bears against the developing roller 10, whereby the chance for contacting with the toner increases and the capability of stripping off the toner increases.

Also, the stripping belt 17 is grounded, and by an electric field formed between the developing roller 10 and the stripping belt 17 by the application of a bias from the bias voltage source E, the toner left on the developing roller 10 after development is stripped off, and flies and adheres to the stripping belt 17.

The electrical resistance of the brush fiber of the stripping belt 17 is set to $10^9$ Ω, and if the electrical resistance is $10^6$ Ω or less, the leak of electricity will occur, and if the electrical resistance is $10^{13}$ Ω or greater, bad stripping by the charge-up of the brush fiber will occur.

The stripped-off toner adheres to and is conveyed by the stripping belt 17, and is struck by the flicker bar 23 at the trailing end thereof in the direction of conveyance, and falls into the third agitating chamber C. The flicker bar 23, as compared with a scraper, has the merit that it enables the stripping belt 17 to operate at low torque and the latitude of the setting thereof is wide and the assembly thereof is easy.

The toner which has fallen into the third agitating chamber C contacts with a great deal of toner around it for a sufficient time and a sufficient number of times, whereby radiation takes place effectively, and further the toner is conveyed to the second agitating chamber B, where radiation also takes place, and therefore the toner is conveyed to the first agitating chamber A, and is again supplied to the developing roller 10, and when it passes the developing blade 4, its temperature rise is slight, and even a low fusing point toner liable to be deteriorated can be prevented from being deteriorated.

In the present embodiment, as the toner T, use is made of a polymeric toner having the core/shell structure and containing paraffin wax which is a low softening point substance as a core substance. The prescription of the polymeric toner is as follows:

| | |
|---|---|
| styrene monomer | 165 g |
| n-butyl acrylate | 15 g |
| salicylic acid metal compound (charging control agent) | 3 g |
| saturated polyester (polarity resin, acid value 14, peak molecular weight 8000) | 10 g |
| paraffin wax (molding lubricant, fusing point 60° C.) | 50 g |

In the developing apparatus, the polymeric toner containing such paraffin wax melted at a low temperature is liable to fuse to the developer carrying member and the toner regulating member and cause bad images such as streaks, but in the present embodiment, the toner on the developing roller 10 is stripped off by the stripping belt 17 to thereby prevent the toner from continuously passing the developing blade 4 and the nip portion of the supply roller 11 while adhering to the developing roller 10 and therefore, the temperature rise of the toner can be suppressed. Also, the stripped-off toner is conveyed to the third agitating chamber C by the stripping belt 17 and is returned to the first agitating chamber A via the third agitating chamber C and the second agitating chamber B and therefore, in the third agitating chamber C and the second agitating chamber B in the meantime, heat can be radiated by effective radiation and an extended radiation time.

Accordingly, the temperature of the toner is sufficiently reduced by the time when the toner is supplied to the developing roller 10, and the deterioration of the toner during the frictional contact between the developing blade 4 and the supply roller 11 can be suppressed, and by the polymeric toner having a low softening point substance, a good toner coat can be obtained for a long period without fusing to the developing roller 10 and at the same time, the fixation temperature of the toner drops greatly and therefore, a reduction in the consumed electric power of the entire image forming apparatus becomes possible.

The developing apparatus 40 of the present embodiment is of a type incorporated into a process cartridge, but may be of a type singly incorporated into an image forming apparatus and used, and in that case, for example, an opening portion may be provided in the third agitating chamber C so that when the amount of remaining toner has become small, fresh toner can be sequentially supplied to the third agitating chamber C, whereby it is possible to make the downsizing and longer life of the developing apparatus compatible.

As described above, the stripping member such as the scraper is installed for the developer carrying member to thereby strip off any developer left on the developer carrying member and prevent the developer from continuously passing the developer regulating member while adhering to the developer carrying member, and also convey the stripped-off developer to the chamber area of the developing container remote from the developer carrying member by the developer conveying member such as an inclined conveying plate so that radiation may be effectively done by a great deal of toner present in the chamber area and therefore, the deterioration of the developer by frictional heat can be prevented. Accordingly, the deterioration of chargeability and fluidity resulting from the fusion of the developer to the developer carrying member or the like and the melting of the surface of the developer can be prevented, and it has become possible to greatly extend the service life of the polymeric toner containing a low softening point substance and the service life of the developing apparatus. Also, the developer can be applied onto the developer carrying member in the form of a developer layer of a uniform charging amount and layer thickness irrespective of the development history in the past, and there can be obtained images of high quality in which sleeve ghost and irregular halftone are prevented.

Embodiment 4

Figure 9:
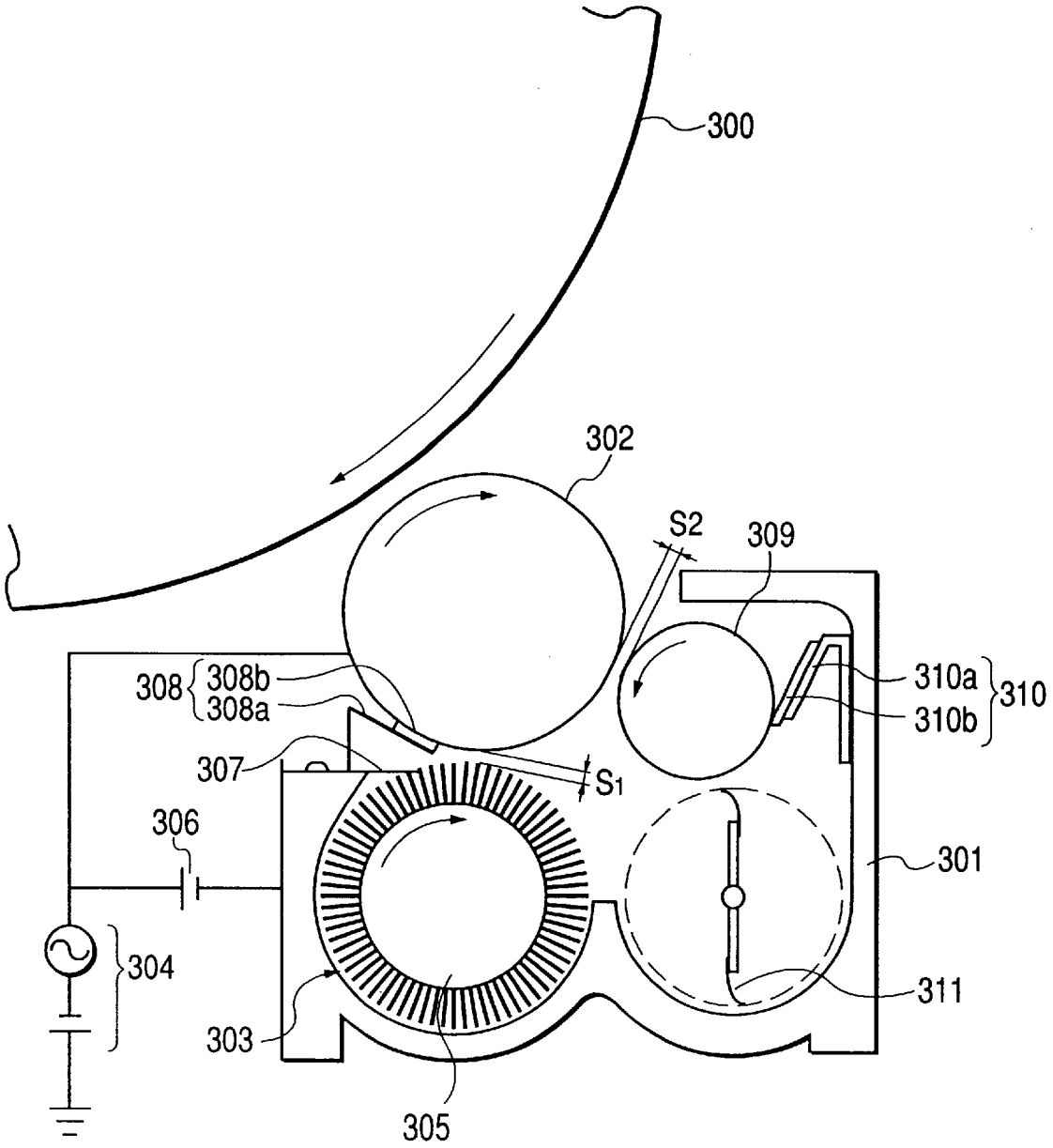
FIG. 9 is a cross-sectional view showing a fourth embodiment of the developing apparatus of the present invention.
Figure 10:
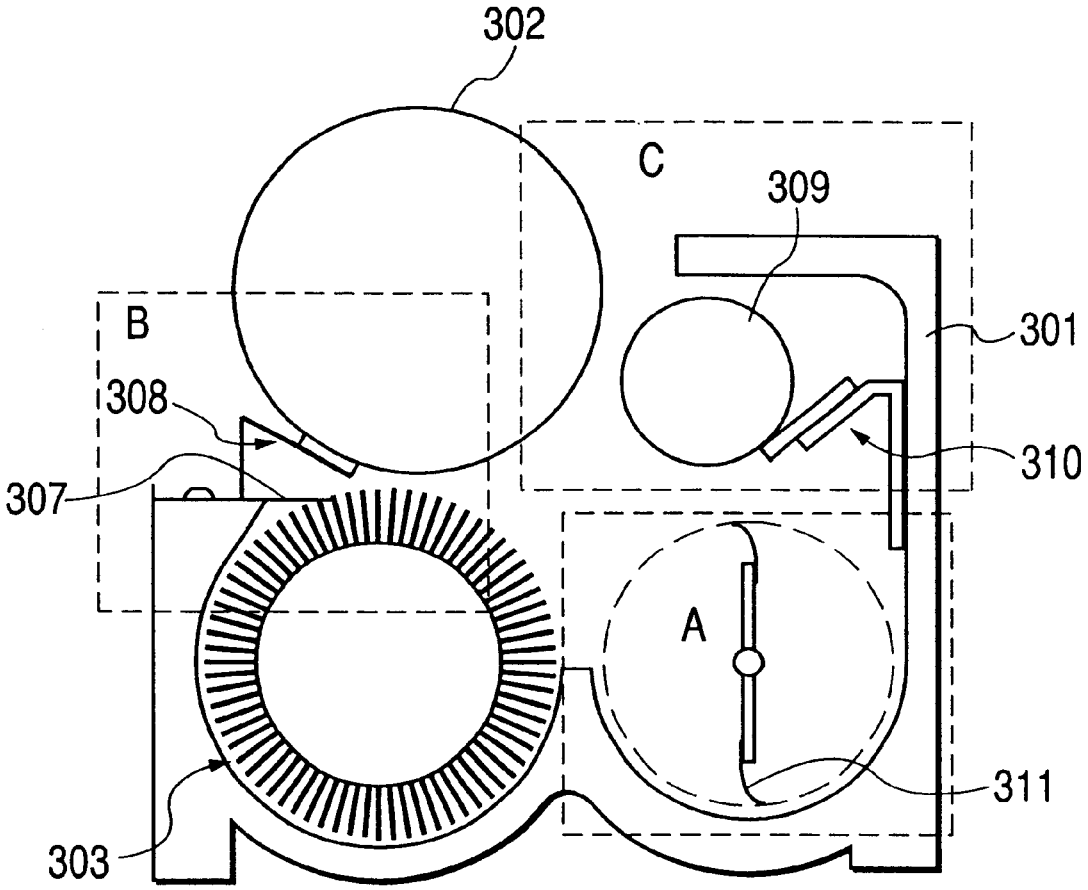
FIG. 10 schematically shows the construction of the developing apparatus.

FIG. 9 shows a fourth embodiment of the developing apparatus of the present invention. In this embodiment, the developing apparatus is provided with a developing container 301, the interior of which is comprised of an area A as a developer containing portion containing therein a developer, i.e., a non-magnetic one-component toner, an area B as a developer supplying portion, and an area C as a developer collecting portion, as shown in FIG. 10.

A developing roller 302 as a developer carrying member is rotatably carried in the developing container 301, and forms a developing portion which faces an image bearing member on which an electrostatic latent image is formed, for example, a drum-like electrophotographic photosensitive member, i.e., a photosensitive drum 300, and makes the electrostatic latent image on the photosensitive drum 300 into a visible image (toner image). The developing roller 302 is also opposed to a roller-like toner supplying brush 303 as a developer supplying member for supplying the toner to the developing roller 302, and forms the developer supplying portion B. The developing roller 302 and the toner supplying brush 303 are rotatively driven in the directions of arrows.

A developing bias voltage source 304 is connected to the developing roller 302, and a desired developing bias voltage comprising an AC voltage superposed on a DC voltage is applied to the developing roller 302. Also, in the present embodiment, the mandrel 305 of the toner supplying brush 303 is connected to the developing bias voltage source 304 through a DC power source 306, and a desired electric field is formed between the toner supplying brush and the developing roller 302.

In the present embodiment, the developing roller 302 is a metallic roller, whereas the material thereof is not limited to a metal, but when for example, use is made of a contact developing method wherein development is effected with the developing roller 302 brought into contact with the photosensitive drum 300, the developing roller 302 may be an elastic developing roller having one or more elastic layers on a mandrel. In this case, as the material of the elastic layer or layers, use can be made of an ordinary rubber material such as silicone rubber, NBR rubber, EPDM rubber or urethane rubber, and further, an elastic layer having its surface covered with electrically conductive resin film comprising carbon or the like dispersed in resin such as nylon. Also, the hardness of the rubber of the elastic layer or layers, including the electrically conductive film on the surface, may suitably be 20 to 70 degrees as measured by JIS A rubber hardness meter. Also, the surface roughness of the elastic layer or layers may desirably be 1 to 20 $\mu$m in $R_z$ value, with the conveyability of the toner taken into account, and is suitably set in conformity with the particle diameter and shape of the toner used. The volume resistance value of the elastic developing roller may desirably be set so as to be of the order of $10^3$ to $10^9$ Ω·cm in a state including the above-described electrically conductive resin film.

The toner supplying brush 303 for supplying the non-magnetic one-component toner in the developing container 301 to the developing roller 302 has its distance $S_1$ to the developing roller 302 maintained at about 100 $\mu$m to 1 mm, and is installed for rotation in the same direction (the opposite direction in the nearest portion) as the direction of rotation of the developing roller 302.

Figure 13A:
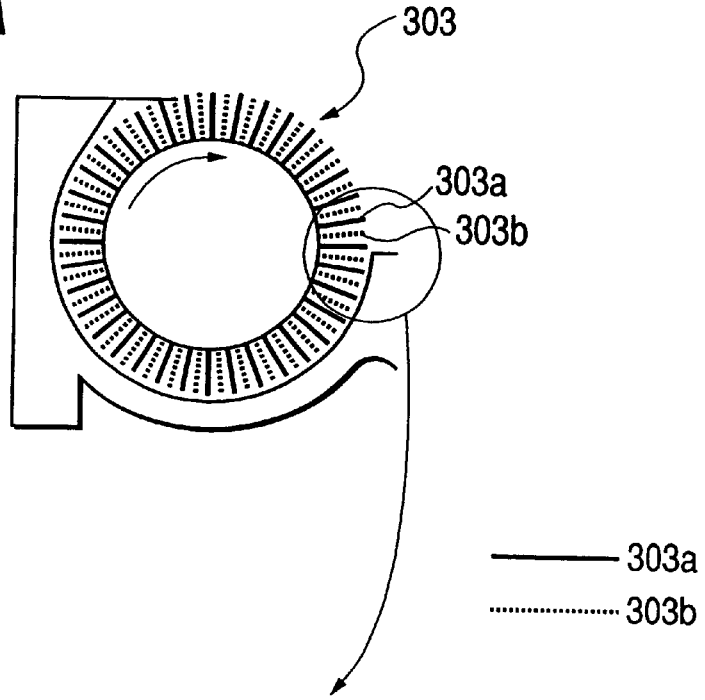
FIG. 13A is a side view of a roller-like toner supplying brush.
Figure 13B:
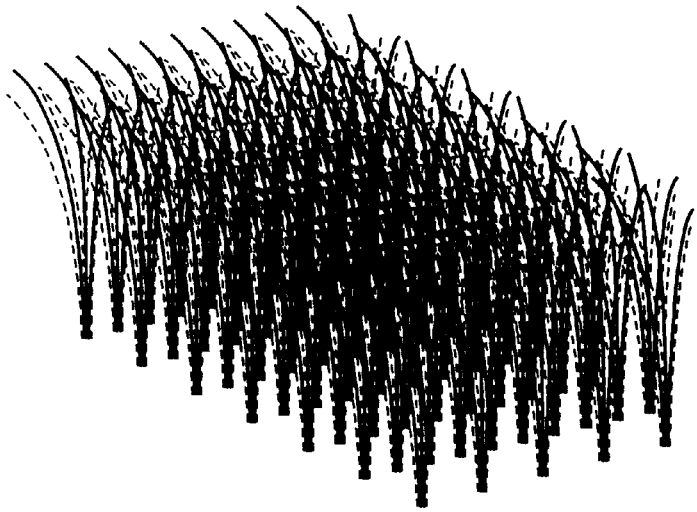
FIG. 13B is a fragmentary enlarged perspective view of the roller-like toner supplying brush of FIG. 13A.

The fiber constituting the toner supplying brush 303 may be one having electrical conductivity alone, but in the present embodiment, as shown in FIGS. 13A and 13B, use is made of a fur brush comprising a brush member consisting of a mixture of electrically conductive fiber 303*a* having an electrical characteristic of low resistance ($10^2$ to $10^8$ Ω·cm) and insulative fiber 303*b* of high resistance ($10^8$ to $10^{15}$ Ω·cm) and wound on a metallic mandrel such as SUS.

Further, in the present embodiment, a non-magnetic one-component toner having the negative charging polarity is used as the developer and therefore, it is desirable that the insulative fiber 303*b* constituting the toner supplying brush 303 has a charging characteristic of positive polarity. Accordingly, in the present embodiment, use is made of insulative fiber of nylon ($10^8$ to $10^{15}$ Ω·cm). Of course, the insulative fiber is not limited to nylon, but any suitable insulative fiber can be selected in conformity with the characteristic of the toner, and in the case of the present embodiment, the insulative fiber may be a material such as rayon.

Figure 14:
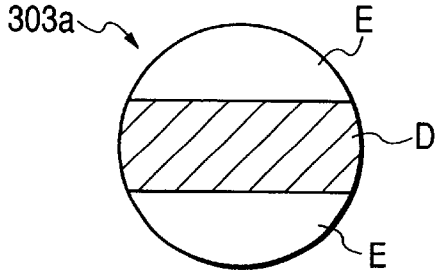
FIG. 14 is a cross-sectional view of an embodiment of a fiber constituting the brush.

On the other hand, the electrically conductive fiber 303*a* must firstly satisfy the above-mentioned volume resistance value, but most of the electrically conductive fiber 303*a* is often spun with electrically conductive resin such as carbon dispersed in insulative fiber, and the dispersing methods are various in fiber manufactures, and the electrically conductive resin is not always exposed on all the surface of the yarn. That is, as will be understood from the cross-section of the electrically conductive fiber 303*a* shown in FIG. 14, an insulating portion E is present on the surface of the electrically conductive fiber 303*a*, besides an electrically conducting portion D, and therefore, with the contact between the toner and the insulating portion E taken into account, it is desirable to choose a material having a positive charging characteristic for the toner as the basic constituent material of the electrically conductive fiber 303*a*. Accordingly, in the present embodiment, electrically conductive fiber 303*a* of nylon is used.

Also, an elastic force for making the toner cloudy is required of the fiber 303 used in the present embodiment, and therefore, the fineness of both of the electrically conductive fiber 303*a* and the insulative fiber 303*b* is 1 to 10 deniers/filament, and in their mixed state, they have flocking density of 1 to 200,000 lines/(inch)$^2$, and the pile length was set so as to be 1 to 10 mm.

The developing apparatus further has a developer flow path controlling member 307 for making the toner cloudy from the toner supplying brush 304 and bearing and driving out the toner toward the developing roller 302. The developer flow path controlling member 307 is disposed so that a portion thereof may be in contact with the toner supplying brush 303. In the present embodiment, the developer flow path controlling member 307 is made of a metallic thin plate having a thickness of the order of 100 μm to 1 mm. In the present embodiment, as shown in FIG. 9, a straight thin plate is used, whereas the shape is not restricted thereto, but can be molded into a desired shape, depending on the direction for making the toner cloudy.

Also, with the imparting of charges to the toner which intervenes on the surface of contact between the developer flow path controlling member 307 and the toner supplying brush 303 taken into account, the developer flow path controlling member 307 may be made of carbon dispersed in resin e.g., nylon, which is high in the capability of imparting charges to the toner, the mixture of carbon and nylon being laminated on the surface of contact between the controlling member 7 and the brush. By adopting such a construction, the imparting of charges to the toner becomes more stabilized.

According to the present embodiment, the developing apparatus has a developer layer thickness regulating member 308 bearing against the developing roller 302 to regulate the layer thickness of the toner applied to the developing roller 302. In the present embodiment, the developer layer thickness regulating member 308 has a metallic thin plate 308*a* having a thickness of the order of 0.1 mm, and an elastic member 308*b* which is a rubber material such as urethane or silicone of 50 to 70 degrees as measured by JIS A rubber hardness meter laminated on the tip end of the thin plate 308*a*.

Also, when the above-described elastic developing roller is used as the developing roller 302, it is desirable that a metallic thin plate 308*a* having a thickness of the order of 0.1 mm be used as the developer layer thickness regulating member 308. Further, its shape is such that at a position of about 2 mm from its tip end portion, it is bent in a direction opposite to the elastic developing roller, and that bent portion contacts with the elastic developing roller with line pressure of about 20 g/cm in such a manner as to eat into the latter.

The developer on the developing roller 302 which has not contributed to development, i.e., the toner left after development, is electrically stripped off from the surface of the developing roller 302 by a toner collecting roller 309 as a developer collecting member disposed adjacent to the developing roller 302 in the developer collecting portion C, and is returned into the developing container 301, whereafter it is used again in the developing portion for carrying out the developing process.

In the present embodiment, the toner collecting roller 309 is installed at a distance $S_2$ of about 100 μm to 1 mm from the developing roller 301 for rotation in the opposite direction (the same direction in the nearest portion) to the direction of rotation of the developing roller 302. In the present embodiment, a cylindrical metallic member having a mirror surface as its surface is used as the toner collecting roller 309, and is electrically grounded, but with the parting property of the toner to be collected taken into account, surface treatment using fluorine resin such as Teflon may be effected on the surface of the roller. For example, a roller surface formed by being quench-plated with nickel, chromium or the like, and fluorine resin melted into cracks in the plated surface formed at that time enhances the parting property of the toner and on the other hand, makes the toner left after development easier to collect by the electric field concentrating effect by the fluorine resin (the insulating portion) and the plating (the electrically conducting portion).

A developer stripping member (scraper) 310 is disposed to strip off the toner collected by the toner collecting roller 309 from the surface of the toner collecting roller 309 and return it to the developer containing portion A. In the present embodiment, the scraper 310 has a metallic thin plate 310*a* having a thickness of the order of 1 mm, and an elastic member 310*b* which is a rubber material such as urethane or silicone of 50 to 70 degrees as measured by JIS A rubber hardness meter laminated on the thin plate 310*a*. This elastic member 310*b* is disposed so that the tip end (edge) thereof may bear against the surface of the toner collecting roller 309, and is designed to mechanically scrape off the toner from the toner collecting roller 309. The toner thus scraped off falls into the developer containing portion A in which an agitating member 311 is disposed, and is supplied to the toner supplying brush 303 by the agitating member 311.

Thus, according to the present embodiment, the edge position of the scraper 310 is set such that almost all of the toner scraped off from the toner collecting roller 309 is reliably returned to the developer containing portion A.

The toner used in the present embodiment is a non-magnetic one-component toner having a weight average diameter of 5 μm or larger and having a coloring agent mixed with and dispersed in thermoplastic resin and crushed, and as the thermoplastic resin, use was made of resin of polystyrene or polyester or the like containing a negative charge controlling agent.

According to the present embodiment, an OPC photosensitive member was used as the photosensitive drum 300, and the photosensitive drum 300 was uniformly charged to the negative polarity by a primary charger, whereafter image exposure was effected by exposure means to thereby form an electrostatic latent image on the photosensitive drum 300, and this electrostatic latent image was reversely developed to obtain a toner image. That is, the electrostatic latent image on the photosensitive drum 300 was reversely developed by the non-magnetic one-component toner of negative polarity by applying to the developing roller 302 a developing bias voltage which was a voltage from the voltage source 304 comprising a DC voltage of negative polarity and an AC voltage superposed one upon the other.

Describing the operation of the developing apparatus of the present embodiment, the toner in the developer containing portion A of the developing container 301 is sent to the toner supplying brush 303 by the agitating member 311, and contacts with the mixed fibers of the toner supplying brush 303, whereby it is charged to the negative.

Figure 15:
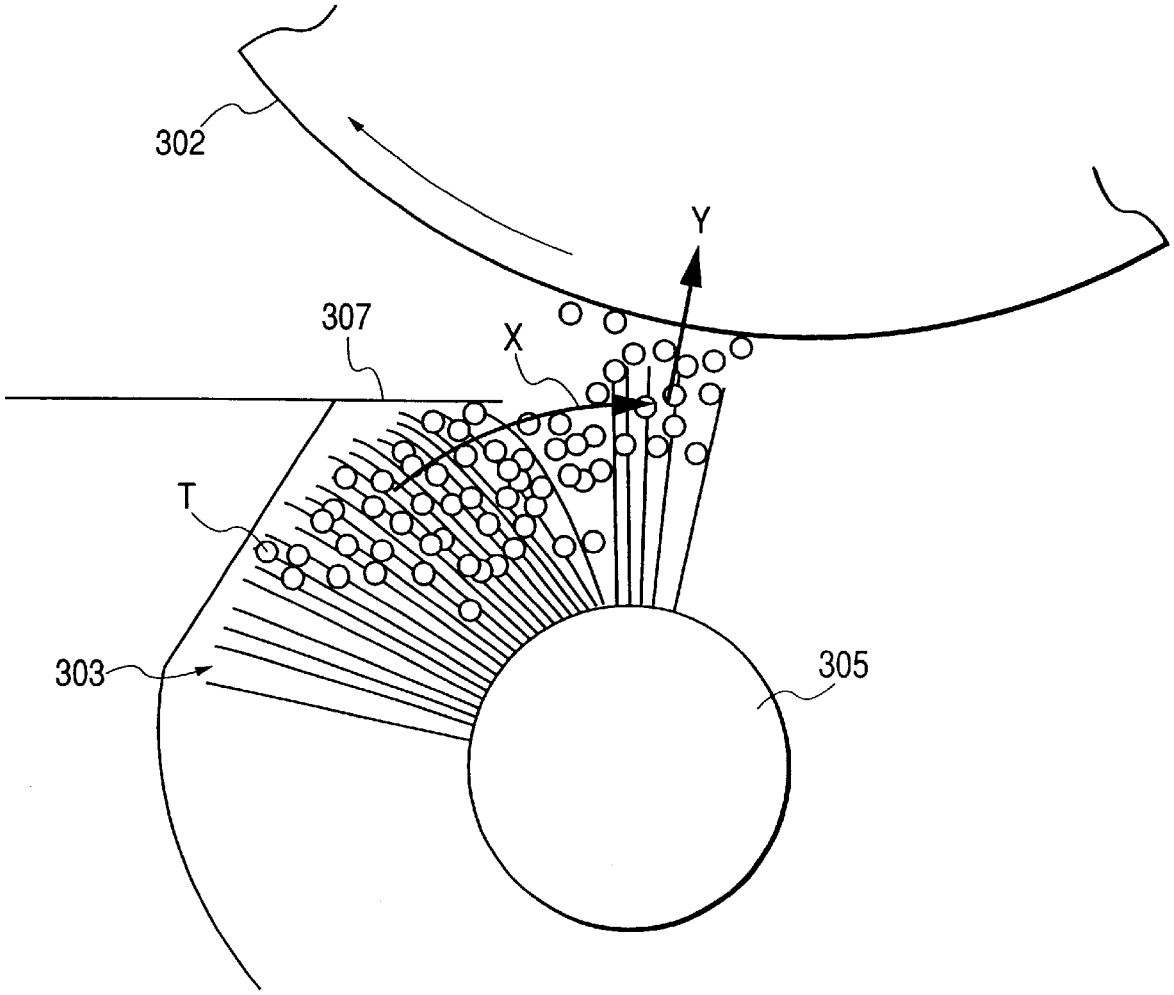
FIG. 15 illustrates a toner supplying method in the developing apparatus.

At this time, as shown in FIG. 15, the toner T is carried between the fibers of the toner supplying brush 303 and on the surface thereof by an adhesive force such as a reflecting force, and is conveyed toward the developer flow path controlling member 307 with the rotation of the toner supplying brush 303. The toner T conveyed to the portion of contact with the developer flow path controlling member 307 contacts with the developer flow path controlling member 307, whereby charges are more stably imparted to the toner, and after the toner has passed the toner supplying brush 303, it is sprung out in the direction of rotation of the brush 303 by the elastic force of the fibers, and becomes cloud-like and flies in the direction of arrow X, as shown in FIG. 15. Further, between the toner supplying brush 303 and the developing roller 302, the toner T is attracted toward and carried on the surface of the developing roller 302 in the direction of arrow Y by an electric field formed by a developing bias voltage applied to the developing roller 302 by the voltage source 304 and a voltage applied to the toner supplying brush 303 by the voltage source 306.

Figure 16:
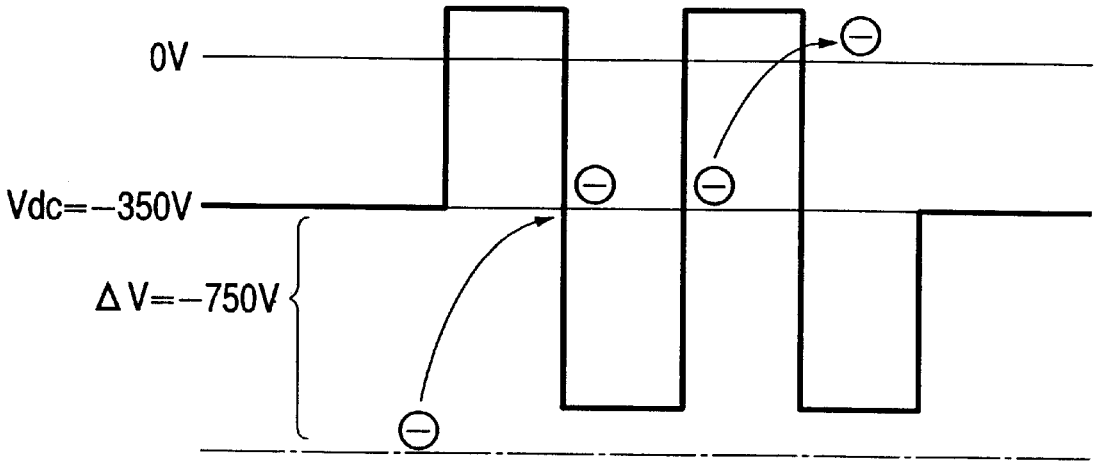
FIG. 16 illustrates a bias construction according to an embodiment during toner supply.
Figure 17:
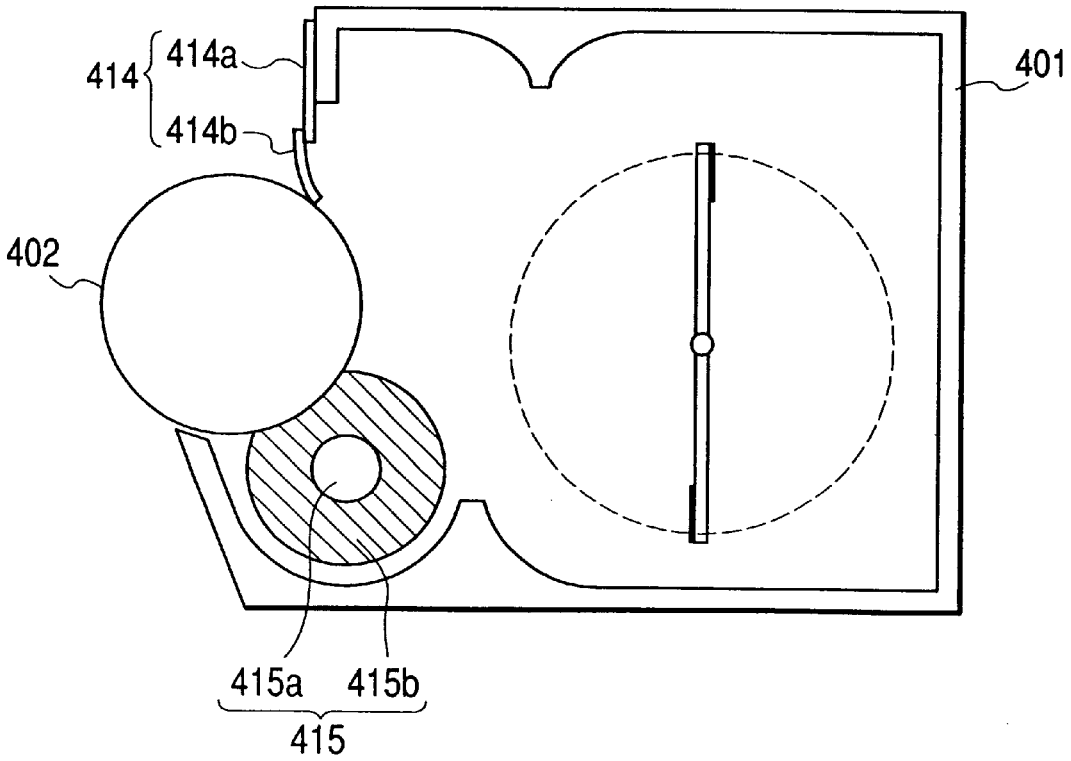
FIG. 17 is a cross-sectional view of the developing apparatus.

When as shown, for example, in FIG. 16, the DC component of the developing bias voltage is set as $Vd_c$=−350 V, if a bias voltage comprising a DC voltage of the order of $\Delta V=-750$ V superposed on this developing bias voltage is set so as to be applied to the toner supplying brush 303 by the voltage source 306, the toner T charged to the negative flies from the toner supplying brush 303 to the developing roller 302 by the action of the electric field by the difference of the DC voltage.

The construction in which the toner supplying brush 303 is brought into contact with the developer flow path controlling means 307 to thereby beat and drive out the toner T can also prevent the clogging of any unchanged toner remaining among the brush fibers.

The toner supplied onto the developing roller 302 in this manner is carried on the developing roller 302 by the reflecting force, whereafter it is conveyed to the blade 308*a* which is the developer layer thickness regulating member 308, and by this blade 308*a*, the thinning of the toner layer and the imparting of further frictional charging charges are effected. By this step, a thin and dense toner layer having a uniform charge amount distribution is formed.

According to the developing apparatus of the present embodiment, as described above, the charged toner is once made cloudly and the toner is supplied onto the developing roller 302 without contact by an electric field coat, whereby the mechanical stress to the toner can be remarkably reduced, and only the sufficiently charged toner is supplied onto the developing roller 302 and therefore, the charge amount distribution in the toner layer has small deviation and becomes very sharp, and stable images of high quality can be obtained.

On the other hand, the toner which has not contributed to development in the developing portion and has been returned into the developing container 301 while being carried on the developing roller 302 is electrostatically carried and collected onto the surface of the toner collecting roller 309 by an electric field formed in the most proximate portion between the toner collecting roller 309 and the developing roller 302. The collected toner is conveyed into the developing container with the rotation of the toner collecting roller 309, and is scraped off into the developer containing portion A by the scraper 310.

By using such a cylindrical toner collecting roller 309 and the scraper 310, the surface of the toner collecting roller 309 always becomes a fresh electrode surface to the developing roller 302 and therefore, a stable electric field is always formed between the toner collecting roller 309 and the developing roller 302. Thus, by making a toner circulation path for completely separating the toner left after development from the developing roller 302 and reliably collecting it in the developer containing portion A, the toner does not receive a continuous load and heat generation is prevented, and accordingly the progress of the deterioration of the toner can be minimized. As the result, the service life of the toner is markedly extended and it is possible to effect good image formation for a long time.

Embodiment 5

Figure 11:
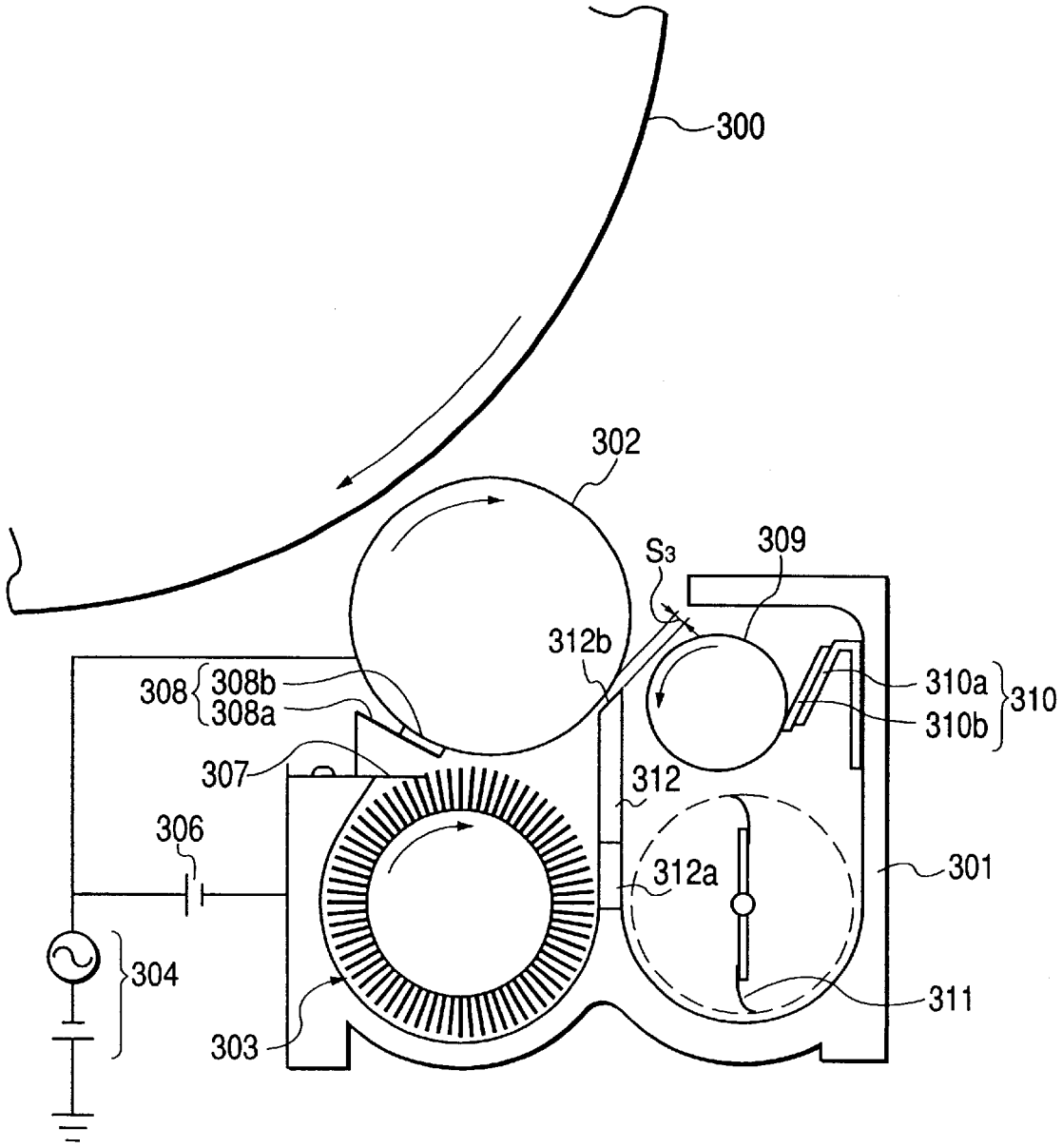
FIG. 11 is a cross-sectional view showing a fifth embodiment of the developing apparatus of the present invention.

FIG. 11 shows a fifth embodiment of the developing apparatus of the present invention. While the developing apparatus described in Embodiment 4 adopts a construction in which the toner left after development collected on the toner collecting roller 309 by the scraper 310 as the toner stripping member is collected into the developer containing portion A, whereby the toner does not continuously receive a load, in the present embodiment, as shown in FIG. 11, a partition member 312 as a partition wall is further provided between the developer containing portion A and the developer supplying portion B, whereby it becomes possible to make the collection of the toner into the developer containing portion A more reliable.

Figure 12:
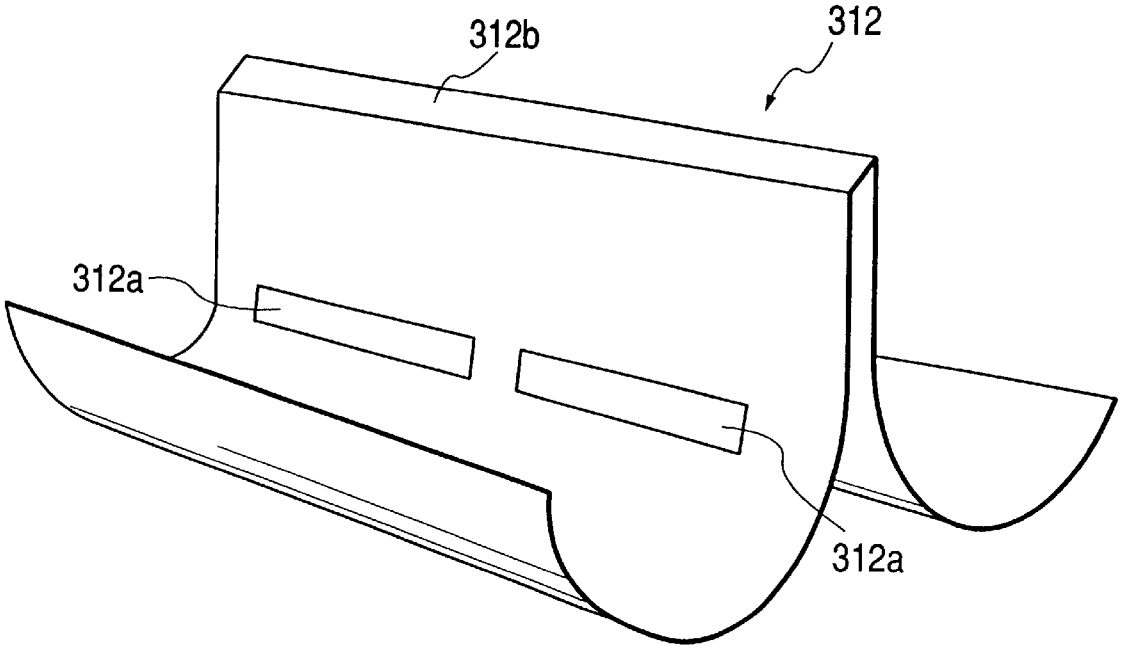
FIG. 12 is a schematic perspective view of a partition member.

FIG. 12 schematically shows the construction of the partition member 312. According to the present embodiment, the partition member 312 is provided with an opening portion 312*a* for supplying the developer in the lower portion thereof, and the end 312*b* thereof is installed at an interval $S_3$ of about 10 to 500 $\mu$m with respect to the developing roller 302.

The toner in the developer containing portion A is sent to the developer supplying portion B from the opening portion 312*a* provided in the lower portion of the partition member 312 by an agitating member 311, and the size of this opening portion 312*a* is suitably set in accordance with a desired amount of toner sent.

Again in the present embodiment, the toner sent to the developer supplying member, i.e., the toner supplying brush 303, is thereafter used in the developing portion for effecting the developing step, as in Embodiment 4, and in the present embodiment as well, the toner left after development on the developing roller 302 is collected by the toner collecting roller 309, and the toner thus collected is further scraped off by the scraper 310. At this time, in the present embodiment, the toner scraped off does not scatter to the developer supplying portion B side because the partition member 312 is provided. Therefore, it becomes possible to return the toner left after development to the containing portion more reliably.

Also, this partition member 312 is effective for the phenomenon that the part of the toner made cloudy by the developer supplying portion B which could not have desired charges passes and scatters through the gap between the developing roller 302 and the toner collecting roller 309.

Thus, according to the present invention, the conventional contact supply, i.e., the supply by the contact and frictional sliding between the toner supplying roller and the developer carrying member can be avoided, and the stress during the supply of the developer can be markedly reduced.

Also, the developer having a proper charge amount is selectively supplied from the developer made cloudy and therefore, not only it is difficult for the uncharged or reversing developer to be supplied, but as the result, the charges imparted to the developer by the developer layer thickness regulating member may be small in quantity. That is, it becomes possible to reduce the contact pressure of the developer layer thickness regulating member, and the load to the developer can be more reduced.

Also, the developer which has not contributed to the developing step and has been returned is electrostatically stripped off by the developer collecting member disposed in non-contact with the developer carrying member, and further is reliably returned from the developer collecting member to the developer containing portion by the developer stripping member. By thus adopting a construction having a circulation path for the developer in the developing apparatus, it never happens that the developer which has not contributed to development repetitively passes through the nip portion of the developer layer thickness regulating member and therefore, it never happens that a continuous load is applied to the developer, and the embedding of an extraneous additive or the like by accumulated heat or the like can be remarkably suppressed. That is, the developer is designed to radiate the heat generated by the pressure received in the nip portion of the developer layer thickness regulating member during the circulation.

Thus, the developing apparatus of the present invention can remarkably reduce the load of the developer at the developing step and also can form images of high quality free of fog or the like.

What is claimed is:

1. A developing apparatus having:

a first chamber for containing a one-component developer;

a developer carrying member disposed in said first chamber to be opposite to an image bearing member and for carrying the one-component developer thereon;

a second chamber adjacent to said first chamber and for containing therein the one-component developer;

supplying means disposed in said second chamber and for supplying the one-component developer from said second chamber to said first chamber;

stripping means for stripping off the one-component developer from said developer carrying member; and a guide member for guiding the one-component developer stripped off from said developer carrying member to said second chamber.

2. A developing apparatus according to claim 1, wherein an agitating member for agitating the one-component developer in said first chamber.

3. A developing apparatus according to claim 1, further comprising a supplying member for supplying the one-component developer to said developer carrying member.

4. A developing apparatus according to claim 3, wherein said supplying member is not in contact with said developer carrying member.

5. A developing apparatus according to claim 1, said guide member is inclined so as to lower away from said developer carrying member.

6. A developing apparatus according to claim 1, wherein said stripping means is a scraper.

7. A developing apparatus according to claim 1, wherein said stripping means is a rotatable member, said rotatable member is not in contact with said developer carrying member, and the one-component developer is stripped off from said developer carrying member by an electric field formed between said rotatable member and said developer carrying member.

8. A developing apparatus according to claim 7, wherein the one-component developer stripped off from said developer carrying member and adhering to said rotatable member is stripped off from said rotatable member and guided to said second chamber.

9. A developing apparatus according to claim 7, wherein said rotatable member is a belt, and the one-component developer stripped off from said developer carrying member and adhering to said belt is guided to said second chamber by said belt.

10. A developing apparatus according to claim 9, further having a third chamber for containing therein the one-component developer to be supplied to said second chamber, and wherein the one-component developer stripped off from said developer carrying member and adhering to said belt is guided to said third chamber by said belt.

11. A developing apparatus according to claim 9, wherein a surface layer of said belt is a brush layer.

12. A developing apparatus according to claim 11, wherein an electrical resistance value of fibers forming said brush layer is greater than $10^6$ Ω and smaller than $10^{13}$ Ω.

13. A developing apparatus according to claim 9, wherein the one-component developer adhering to said belt is beaten down in a downstream side end portion of said belt in a direction of guide of the one-component developer.

14. A developing apparatus according to claim 1, wherein an upwardly extending portion is provided between said first chamber and said second chamber.

15. A developing apparatus according to claim 14, wherein said extending portion is provided with an opening through which the one-component developer contained in said second chamber passes when supplied to said first chamber.

* * * * *

UNITED STATES PATENT AND TRADEMARK OFFICE

CERTIFICATE OF CORRECTION

PATENT NO. : 6,229,980 B1
DATED : May 8, 2001
INVENTOR(S) : Kenya Ogawa et al.

It is certified that error appears in the above-identified patent and that said Letters Patent is hereby corrected as shown below:

Column 2,
Line 30, close up right margin.

Column 3,
Line 33, “etc.” should read -- etc., --.
Line 64, “etc.” should read -- etc., --.

Column 4,
Line 24, “N1colet” should read -- Nicolet --.

Column 8,
Line 12, “on” should read -- applied on --.
Line 60, “to.” should read -- to --.

Column 9,
Line 36, “from” should read -- for --.

Column 11,
Line 28, “he” should read -- the --.
Line 54, “ill” should read -- will --.

Column 12,
Line 23, “Thereafter” should read -- whereafter --.

Column 17,
Line 39, “of arrows.” should read -- shown by their respective arrows. --.

Column 19,
Line 11, “resin” should read -- resin, --.
Line 49, “roller 301” should read -- roller 302 --.

Column 21,
Line 23, “cloudly” should read -- cloudy --.

UNITED STATES PATENT AND TRADEMARK OFFICE

CERTIFICATE OF CORRECTION

PATENT NO. : 6,229,980 B1 
DATED : May 8, 2001
INVENTOR(S) : Kenya Ogawa et al.

It is certified that error appears in the above-identified patent and that said Letters Patent is hereby corrected as shown below:

Column 23,
Line 23, “wherein” should read -- Further comprising --.
Line 32, “said” should read -- wherein said --.

Signed and Sealed this

Eleventh Day of June, 2002

*Attest:*

*Attesting Officer*

JAMES E. ROGAN
*Director of the United States Patent and Trademark Office*